US005673062A

United States Patent [19]

Katakura et al.

[11] Patent Number: 5,673,062

[45] Date of Patent: Sep. 30, 1997

[54] LIQUID CRYSTAL APPARATUS

[75] Inventors: Kazunori Katakura; Akira Tsuboyama, both of Atsugi, Japan

[73] Assignee: Canon Kabushiki Kaisha, Tokyo, Japan

[21] Appl. No.: 563,347

[22] Filed: Nov. 28, 1995

Related U.S. Application Data

[63] Continuation of Ser. No. 147,540, Nov. 5, 1993, abandoned.

[30] Foreign Application Priority Data

Nov. 6, 1992 [JP] Japan ..... 4-321485
Nov. 10, 1992 [JP] Japan ..... 4-323773

[51] Int. Cl.[6] ..... G09G 3/36

[52] U.S. Cl. ..... 345/95; 345/97; 345/103

[58] Field of Search ..... 345/43, 87, 94, 345/95, 97, 98, 99, 103, 115, 208; 349/33, 36, 133, 134, 135, 143

[56] References Cited

U.S. PATENT DOCUMENTS

| | | | |
|---|---|---|---|
| 4,412,214 | 10/1983 | Tanaka et al. | 345/43 |
| 4,743,896 | 5/1988 | Hashimoto et al. | 345/98 |
| 4,891,705 | 1/1990 | Suzuki et al. | 345/115 |
| 4,902,107 | 2/1990 | Tsuboyama et al. | 350/350 S |
| 4,965,563 | 10/1990 | Mano et al. | 345/99 |
| 5,018,841 | 5/1991 | Mouri et al. | 345/97 |
| 5,058,994 | 10/1991 | Mihara et al. | 359/56 |
| 5,092,665 | 3/1992 | Kanbe et al. | 345/97 |
| 5,111,317 | 5/1992 | Coulson | 345/208 |
| 5,136,409 | 8/1992 | Fushimi et al. | 359/87 |
| 5,267,065 | 11/1993 | Taniguchi et al. | 345/97 |

FOREIGN PATENT DOCUMENTS

| | | |
|---|---|---|
| 2-30022 | 1/1990 | Japan . |
| 4-23275 | 1/1992 | Japan . |

*Primary Examiner*—Steven Saras
*Attorney, Agent, or Firm*—Fitzpatrick, Cella, Harper & Scinto

[57] ABSTRACT

A matrix display device includes a first electrode plate having thereon a group of display scanning electrodes and a frame scanning electrode outside the display scanning electrodes, a second electrode plate having thereon a group of display data electrodes and a frame data electrode outside the display data electrodes, and a liquid crystal having a memory characteristic disposed between the first and second electrode plats so as to form a display region defined by an overlapping of the display scanning electrodes and the display data electrodes and a frame region outside the display region defined by the frame scanning electrode and the frame data electrode. The liquid crystal is allowed to assume either one of two stable states at each pixel formed at each intersection of any data electrode and any scanning electrode. The matrix device is driven by applying a signal waveform K to the frame region having a wider signal range (margin) for providing one of the two stable states of the liquid crystal than waveforms L and M applied to the display region (FIGS. 5, 6) or by applying different drive signals P' and Q' (FIG. 21) to the frame data electrodes on both outsides 103*d* and 103*e* (FIGS. 2A, 2B).

12 Claims, 21 Drawing Sheets

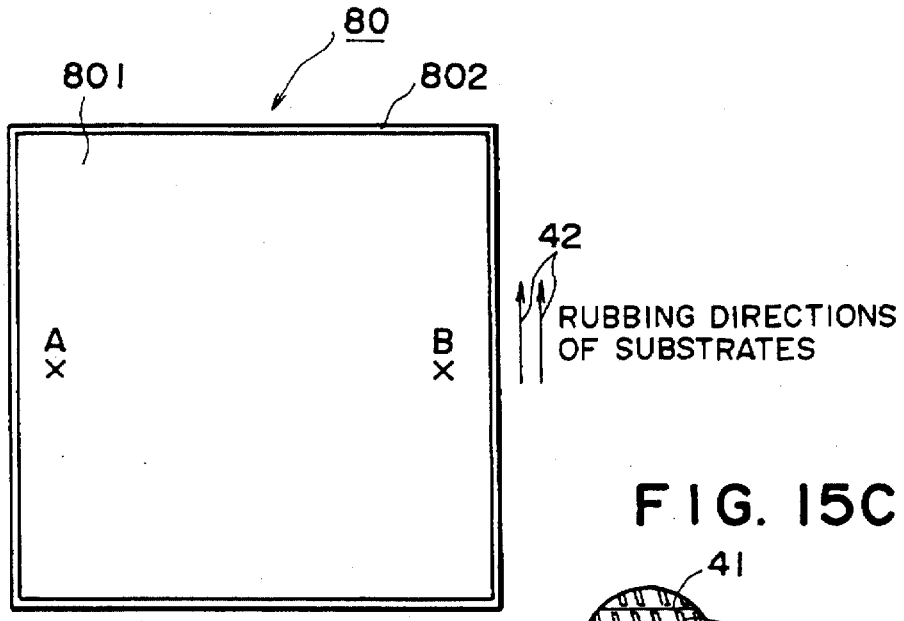
FIG. 15A
FIG. 15C
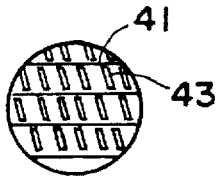
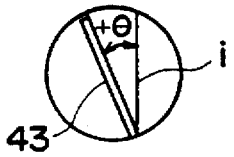
FIG. 15D
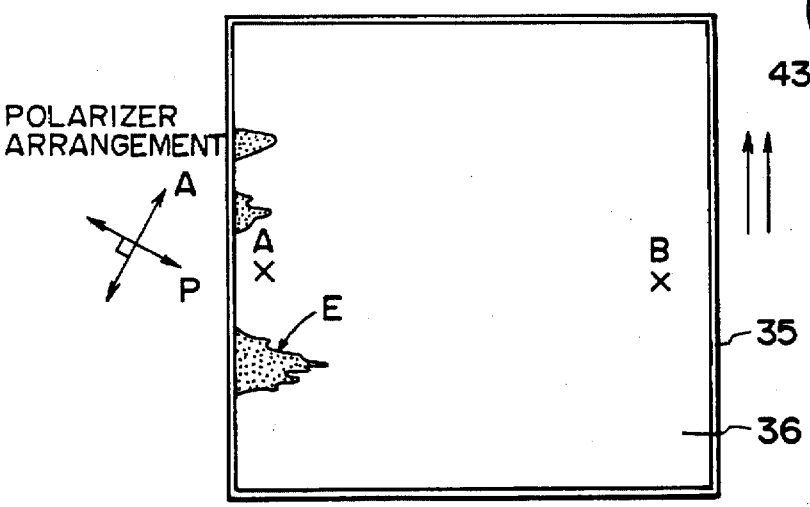
FIG. 15B

FIG. 17A M (A-E)
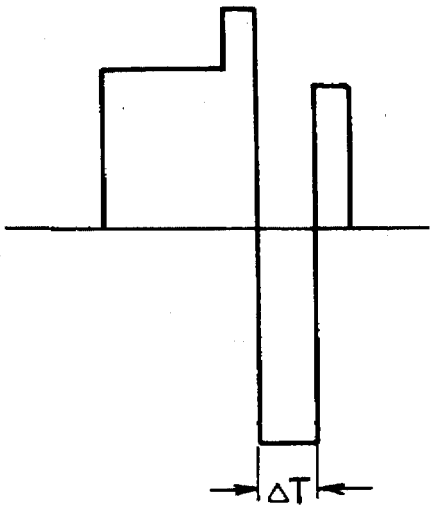
FIG. 17B O (C)
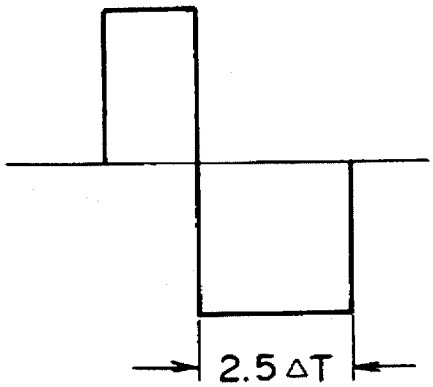
FIG. 17C P (A-G)
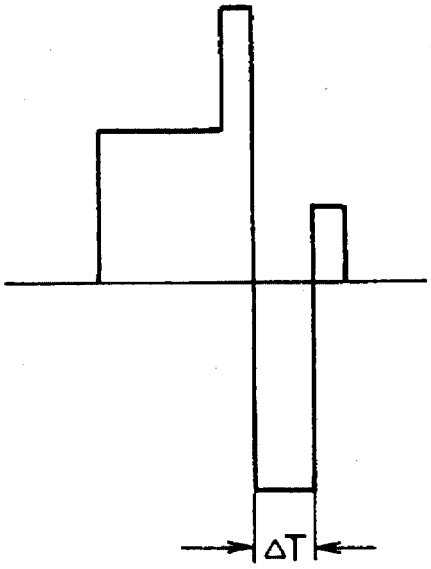

FIG. 21A M' (A'-E')
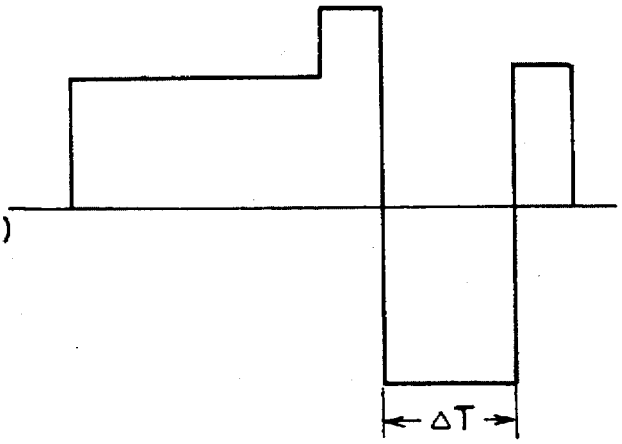
FIG. 21B O' (C')
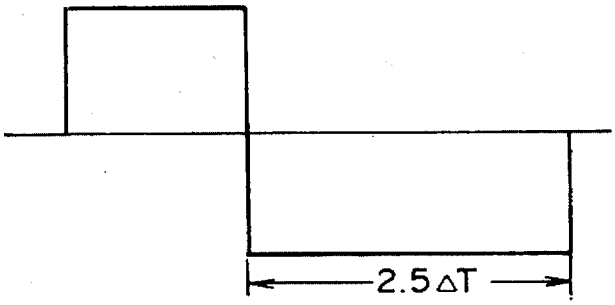
FIG. 21C P' (A'-G')
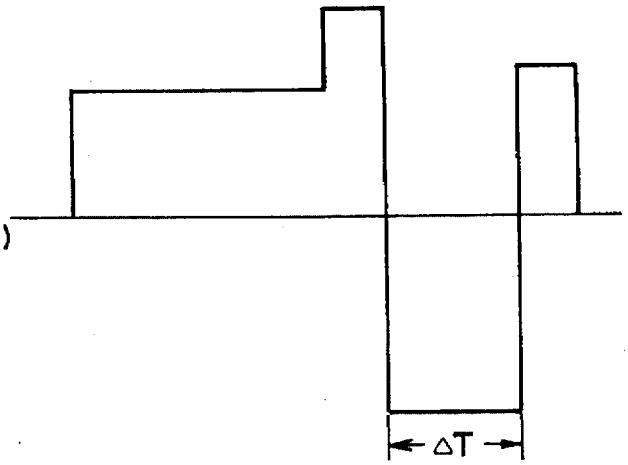
FIG. 21D Q' (A'-H')
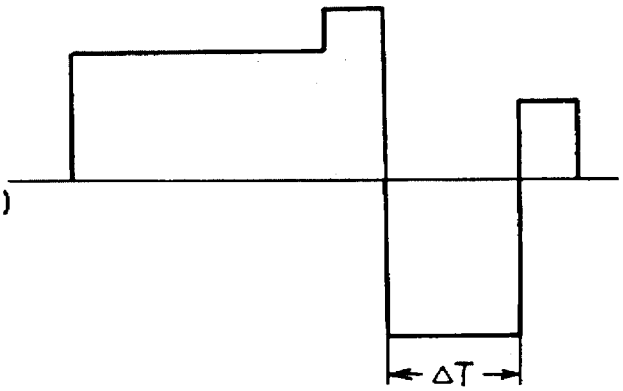

LIQUID CRYSTAL APPARATUS

This application is a continuation, of application Ser. No. 08/147,540 filed Nov. 5, 1993, now abandoned.

FIELD OF THE INVENTION AND RELATED ART

The present invention relates to a liquid crystal display apparatus using a liquid crystal having a memory characteristic, particularly a liquid crystal display apparatus including a panel having a peripheral frame region surrounding a display region.

An electrooptical medium having a memory characteristic may be driven for desired switching by applying an electric field exceeding a threshold, and the resultant state after the switching is retained under no electric field or even under application of an electric field below the threshold. Because of the memory characteristic allowing memorization of data after desired switching by application of writing signals, such a medium can be applied to a large-capacity display device, etc.

As a representative example of such an electrooptical medium having a memory characteristic, a ferroelectric liquid crystal may be raised. When a ferroelectric liquid crystal (FLC) is sandwiched between a pair of substrates subjected to an appropriate aligning treatment to form a cell having a liquid crystal layer sufficiently thin to release a helical structure, two stable states having a memory characteristic are developed.

When at least one polarizer is combined with such a liquid crystal cell, it is possible to discriminate the two stable states as a dark state and a bright state by utilizing the birefringence of the liquid crystal. The switching between the two states may be controlled by an electric signal applied across electrodes formed in desired patterns on the substrates. Such a liquid crystal cell may be generally utilized as a display device in which one substrate is provided with a group of stripe-shaped scanning electrodes and the other substrate is provided with a group of stripe-shaped data electrodes so as to form a pixel at each intersection of the groups of electrodes, in which pixel a bright or a dark state is formed depending on a combination of a scanning signal and a data signal applied thereto.

Such an electrooptical medium having a memory characteristic like a ferroelectric liquid crystal involves a problem as follows when used in a display device.

A display device is generally stored within a housing or a decorative casing for retaining functionality, safety and good appearance and for protecting the electrical system of the device. Depending on the thickness of the housing or casing, however, a part of the display screen can be hidden when viewed in an oblique direction. In order to obviate such difficulty, there has been taken a measure that a frame region (non-display region) is provided surrounding a display region so that an effective display region is not hidden unless it is viewed at an extreme angle outside a certain range of angles.

If such a measure is taken for a medium having a memory characteristic such as FLC, however, as FLC is kept in an arbitrary state until it is supplied with an electric signal exceeding the threshold, the frame region is uncontrolled to provide an ununiform display which can be ugly. Accordingly, the frame region has to be kept in a uniform state by certain electric signals. For this purpose, it is necessary to periodically apply drive signals. Herein, the memory characteristic does not necessary mean a permanent one but may cover a degree of memory characteristic as required by an image quality and a display function for a display device.

For the above purpose, there has been proposed to provide frame drive electrodes outside a display region and apply thereto electric signals similar to those applied to the display region so as to drive the liquid crystal in the frame region, thereby providing a uniform frame region (e.g., Japanese Patent Publication (JP-B) 2-30022 and JP-B 4-23275).

However, in such a liquid crystal device having a frame region, the threshold in the frame region can be remarkably fluctuated due to factors, such that the cell thickness is liable to be increased in the neighborhood of the sealing member, the alignment state is liable to be deteriorated in the neighborhood of the liquid crystal injection port, and a remarkable temperature fluctuation is liable to be caused in the neighborhood of the drive signal application circuit, thus failing to provide a display apparatus showing a satisfactory performance in some cases.

Further, in case of a conventional liquid crystal cell structure, there has been observed a problem regarding the durability of the cell. It is known that ferroelectric liquid crystal molecules are perturbed to some extent in response to non-selection signals during a matrix drive. This is clear from a phenomenon that a pixel supplied with non-selection signals shows an optical response accompanied with a fluctuation in transmitted light quantity in synchronism with the applied pulses of the non-selection signals. Such fluctuation or perturbation of liquid crystal molecules may be tolerable in a so-called splay alignment state (wherein liquid crystal molecular long axes are remarkably twisted in a direction perpendicular to and between a pair of substrates), if the liquid crystal molecules are not switched between stable states thereby, thus retaining displayed data even if some decrease in contrast is caused thereby. In a uniform alignment state (wherein liquid crystal molecules are substantially free from such a twist between a pair of substrates in a direction perpendicular to the substrates), however, such perturbation of liquid crystal molecules caused by repetitive application of non-selection signals can lead to movement of liquid crystal molecules in a smectic layer. This phenomenon will be described in some detail with reference to FIGS. 15A–15D.

FIG. 15A illustrates a state before voltage application, and FIG. 15B illustrates a state after voltage application, respectively, of a liquid crystal device (cell) 80. A ferroelectric liquid crystal 801 is sealed within a sealing member 802 disposed at the periphery of the cell. In this cell, both substrates are provided with polyimide alignment films which are rubbed in upward parallel directions 42. As a result of the treatment, smectic layers 41 are formed in a direction perpendicular to the rubbing directions 42 (FIG. 15C).

If the cell thickness is reduced sufficiently to release the helical pitch, the ferroelectric liquid crystal assumes two stable states. Now, all liquid crystal molecules 43 are placed in one of the two stable states as shown in FIG. 15C. This position is referred to as fθ with respect to a layer normal vector i (see FIG. 15D). The other stable state exist at a position −θ which is symmetrical to the +θ position with respect to the layer normal vector i.

When liquid crystal molecules wholly placed in the state of +θ are supplied with an electric field (e.g., rectangular pulses of 10 Hz, ±8 V), the liquid crystal molecules 43 start to move in a direction of from point A to point B in a smectic layer while retaining their inclination of +θ with respect to the layer normal i. As a result, if such an electric field is continually applied for a long period, the device causes a local change in cell thickness to finally result in parts E void of liquid crystal along the side of A, and the thickness near the side of B is larger than that near the side A. On the other hand, if liquid crystal molecules are placed in the state of $-\theta$, the liquid crystal molecules are moved in a direction of the side B to the side A in the smectic layer to result in liquid crystal voids along the side B.

Such a phenomenon is caused in a relatively short period of 1000–2000 hours. The presence of the liquid crystal void E which is an electrooptically uncontrollable portion is of course not desirable in respect of display quality. Further, such a local change in cell thickness at points A and B will make the control of the entire liquid crystal panel difficult so that this phenomenon has posed a serious problem in an optical device using a ferroelectric liquid crystal.

In case of a liquid crystal device having a peripheral frame region outside the display region, such voids or irregularly large cell thickness portions are liable to occur in a frame region. The occurrence of such voids or irregularly thick cell portions in the frame region causes a large fluctuation in threshold similarly as the above-mentioned cell thickness fluctuation, deterioration of alignment state and temperature change, thus failing to provide a stable display in the frame region and a display apparatus showing a satisfactory performance.

SUMMARY OF THE INVENTION

In view of the above-mentioned problems of the prior art, an object of the present invention is to provide a liquid crystal display apparatus showing an enhanced performance.

Another object of the present invention is to provide a liquid crystal display apparatus showing a stabilized display in the frame region.

According to a first aspect of the present invention there is provided a liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode outside the display data electrodes, and a ferroelectric liquid crystal disposed between the first and second electrode plats so as to form a display region defined by an overlapping of the display scanning electrodes and the display data electrodes and a frame region outside the display region defined by the frame scanning electrode and the frame data electrode, wherein the liquid crystal is allowed to assume either one of two stable states at each pixel formed at each intersection of any data electrode and any scanning electrode, and a drive means for applying a display signal waveform corresponding to given display data to the liquid crystal in the display region, and applying a frame signal waveform providing one of the two stable states of the liquid crystal to the liquid crystal in the frame region, respectively via the electrode plates, wherein the frame signal waveform has a wider signal range (wider range of a drive signal parameter such as a pulse amplitude, a pulse width, etc. (i.e., wider drive margin or latitude) in view of the threshold characteristic of the liquid crystal in association with the single waveform) for stably providing said one of the two stable states of the liquid crystal than the display signal waveform. In this instance, it is preferred to set the frame signal waveform to have a wider signal range for stably providing a bright display state of the liquid crystal than the display signal waveform in view of the threshold characteristic distribution of the liquid crystal for providing the dark to bright state of the liquid crystal.

According to a second aspect of the present invention, there is provided a liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode outside the display data electrodes, and a liquid crystal having a memory characteristic disposed between the first and second electrode plats so as to form a display region defined by an overlapping of the display scanning electrodes and the display data electrodes and a frame region outside the display region defined by the frame scanning electrode and the frame data electrode, wherein the liquid crystal is allowed to provide either one of a bright state and a dark state at each pixel formed at each intersection of any data electrode and any scanning electrode, and a drive means for applying via the electrode plates a signal waveform depending on a desired display state to the liquid crystal in the display region and for applying a signal waveform setting the dark state in the frame region to the liquid crystal in the frame region. In this instance, it is desired that the frame region is set to show a display luminance of at most 2 cd/cm$^2$, or a transmittance of at most 0.1%. In a preferred embodiment, the drive means applies a scanning display selection signal applied to each selected display scanning electrode and a frame scanning selection signal to a selected frame scanning electrode, each of the scanning display selection signal are the frame scanning selection signal includes a pulse for resetting all pixels on a selected scanning electrode into the dark state.

According to a third aspect of the present invention, there is provided a liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode disposed on both outsides of the display data electrodes, and a ferroelectric liquid crystal disposed between the first and second electrode plats so as to form a display region defined by an overlapping of the display scanning electrodes and the display data electrodes and a frame region outside the display region defined by the frame scanning electrode and the frame data electrodes, wherein the liquid crystal is allowed to assume either one of two stable states at each pixel formed at each intersection of any data electrode and any scanning electrode, and a drive means for applying drive signals to the respective electrode to effect a desired display in the display region and a constant display in the frame region, wherein said drive means applies different drive signals to the frame data electrodes on both outsides of the display electrodes.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5 shows some signals applied to pixels based on drive signals shown in FIG. 4.

FIGS. 15A–15D illustrate liquid crystal molecular movement along a liquid crystal panel.

FIG. 17 shows pixel signals based on drive signal waveforms shown in FIG. 16.

FIG. 21 shows pixel signals based on drive signal waveforms shown in FIG. 20.

DESCRIPTION OF THE PREFERRED EMBODIMENTS

An embodiment is described, wherein the present invention is applied to a liquid crystal display apparatus having a liquid crystal panel including 1024 scanning electrodes, 2560 data electrodes 23 frame scanning electrodes on each side of the scanning electrodes and 46 frame data electrodes on each side of the data electrodes.

[First Embodiment]

Figure 1:
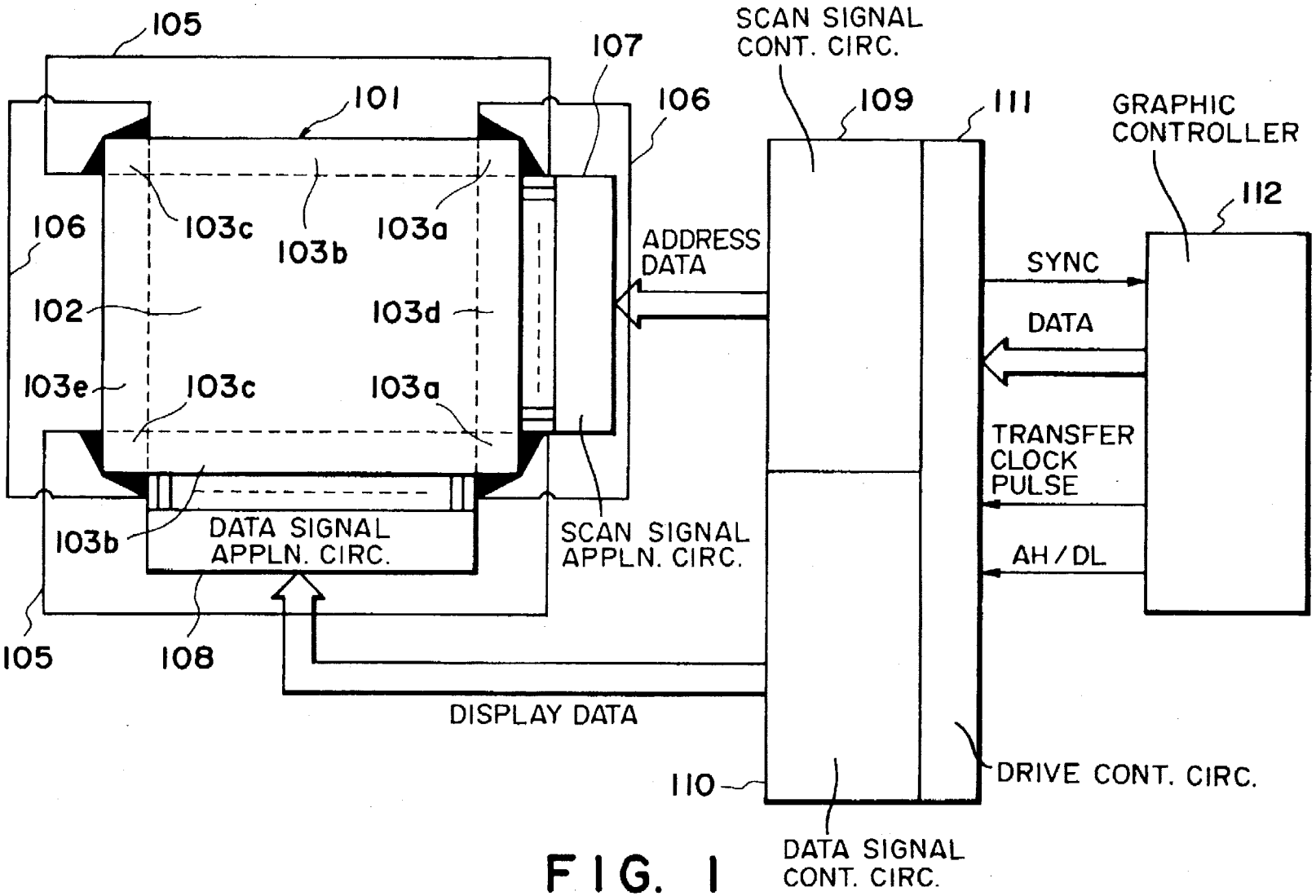
FIG. 1 is a block diagram of a liquid crystal display apparatus according to an embodiment of the present invention.

FIG. 1 shows a circuit structure of a liquid crystal data electrode according to an embodiment of the present invention. Referring to FIG. 1, the display apparatus includes a liquid crystal panel 101 including a display region 102 and frame regions 103*a*, 103*b* and 103*c* (constituted by frame scanning electrodes 203 and frame data electrodes 206 shown in FIG. 2), a wire 105 for connecting both sides of the frame scanning electrodes 203, a wire 106 for connecting both sides of the frame data electrodes 206, a scanning signal application circuit 107, a data signal application circuit 108, a scanning signal control circuit 109, a data signal control circuit 110, a drive control circuit 111, and a graphic controller 112.

Data supplied from the graphic controller 112 is sent via the drive control circuit 111 into the scanning signal control circuit 109 and the data signal control circuit 110 to be converted therein into address data and display data, respectively. According to the address data, scanning signals are generated from the scanning signal application circuit 107 and supplied to scanning electrodes 202 (FIG. 2A, the frame scanning electrodes 203 (FIG. 2A) in the panel 101. The scanning signal application circuit 107 operates in the same manner as in the case where 1024+2 scanning electrodes are driven. On the other hand, according to the display data, data signals are generated from the data signal application circuit 108 and applied to data electrodes 205 (FIG. 2A) and the frame data electrodes 206 (FIG. 2A) in the panel 101. The data signal application circuit 108 operates in the same manner as in the case where 2560+2 data electrodes are driven.

Figure 2A:
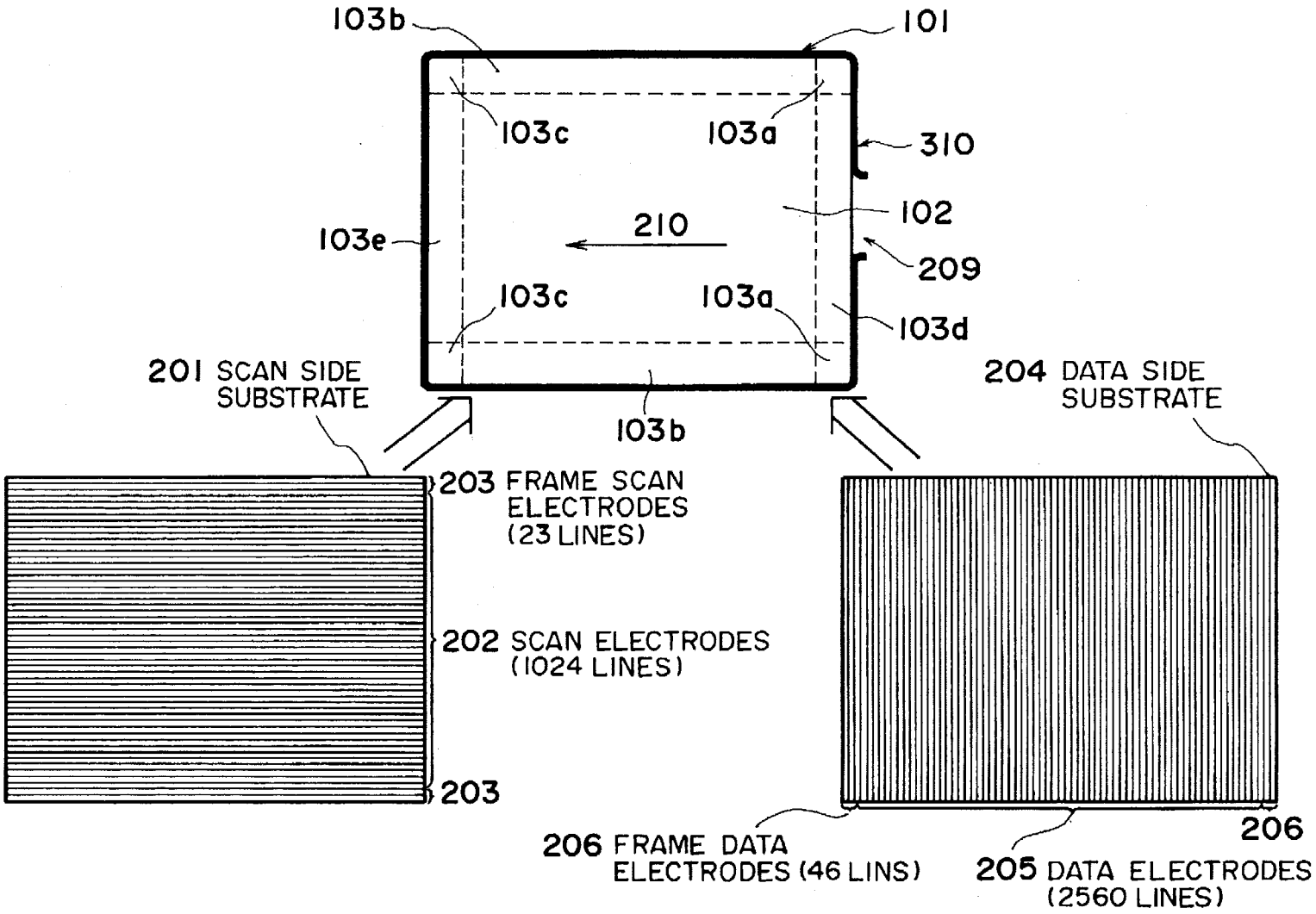
FIG. 2A is a schematic illustration of a panel electrode structure in the apparatus shown in FIG. 1.

FIG. 2A shows an electrode pattern constituting the panel 101. Referring to FIG. 2A, a scanning side substrate 201 is provided with 1024 scanning electrodes 202 and 23 frame scanning electrodes 203 on each side thereof, which makes for a total of 1070 electrodes of identical shape arranged in one direction. A data side substrate 204 is provided with 2560 data electrodes 205 and 46 frame data electrodes on each side thereof, which makes for a total of 2652 electrodes of identical shape arranged in one direction. These two types of electrodes are arranged so that they are perpendicular or nearly perpendicular to each other when the scanning side substrate 201 and the data side substrate 204 are superposed with each other. By the superposition, an electrode matrix is formed.

The panel 101 is provided with a sealing member 310 for sealing the liquid crystal within the panel, and a liquid crystal injection port 209 is disposed on the side of a right frame region 103*d*, and the liquid crystal is injected so as to wet the panel inside from the frame region 103*d* to a frame region 103*e*, i.e., in the direction of an arrow 210.

Figure 2B:
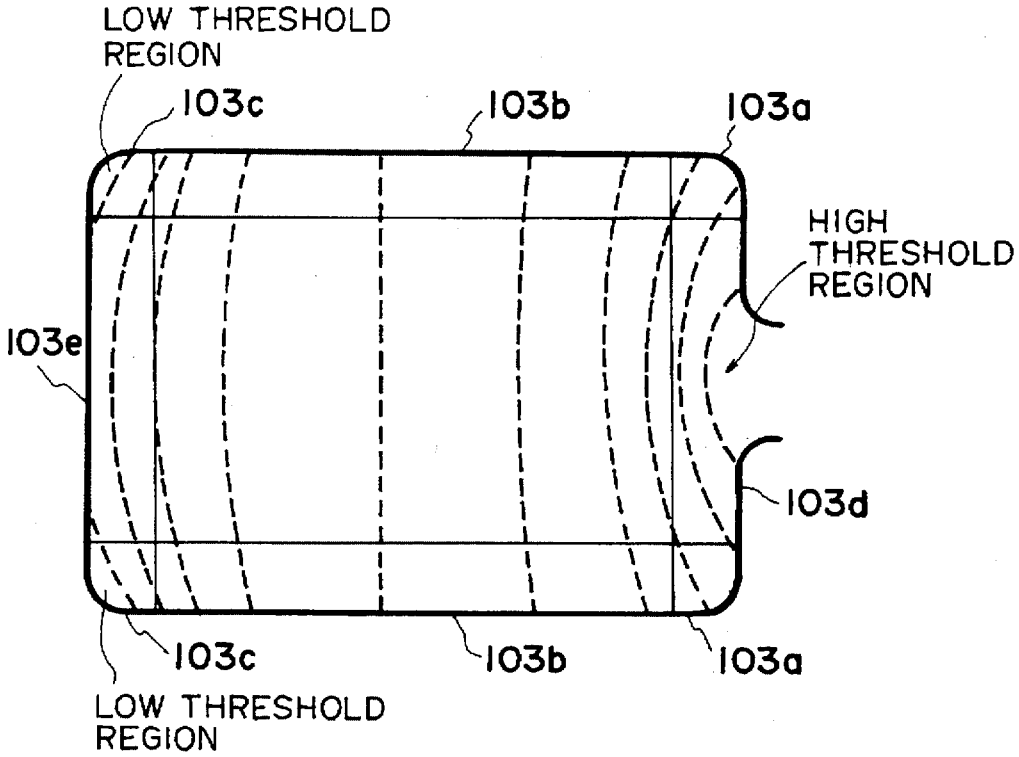
FIG. 2B is an illustration of a threshold distribution in the liquid crystal panel in the apparatus shown in FIG. 1.

When such a liquid crystal injection direction is adopted, the resultant liquid crystal alignment state becomes locally different depending on e.g., the temperature and inner pressure conditions, thus resulting in a threshold distribution with a threshold decreasing in the injection direction or directions forming angles of from −45 degrees to +45 degrees with respect to the injection direction and characterized by dashed iso-threshold lines as shown in FIG. 2B. As a result, the frame region 103*a* is caused to have a higher threshold, and the frame regions 103*b* are caused to have locally remarkably varying thresholds. The frame region 103*c* is provided with a lower threshold, the frame region 103*d* is provided with a higher threshold, and the frame region 103*e* is provided with a low threshold.

Figure 3:
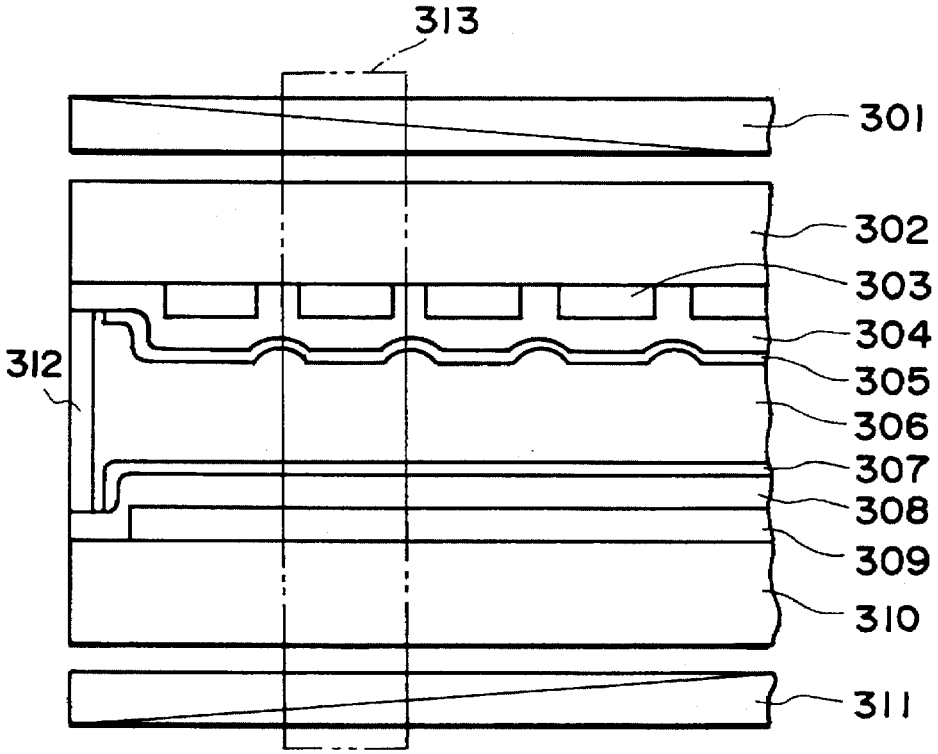
FIG. 3 is a schematic sectional view of the liquid crystal panel shown in FIG. 1.

FIG. 3 is a partial sectional view of the panel 101. Referring to FIG. 3, the panel includes a pair of an analyzer 301 and a polarizer 311 disposed in cross nicols so as to sandwich a cell structure, which in turn includes glass substrates 302 and 310 corresponding to the scanning side substrate 201 and the data side substrate 204, respectively, in FIG. 2, transparent electrodes 303 and 309 corresponding to the scanning electrodes 202 and frame scanning electrode 203 and the data electrodes 205 and frame data electrodes 206, insulating films 304 and 308, alignment films 305 and 307, a ferroelectric liquid crystal 306, and a sealing member 312. A pixel 313 as a display element is formed at each intersection of the transparent electrodes 303 and 309.

Figure 4:
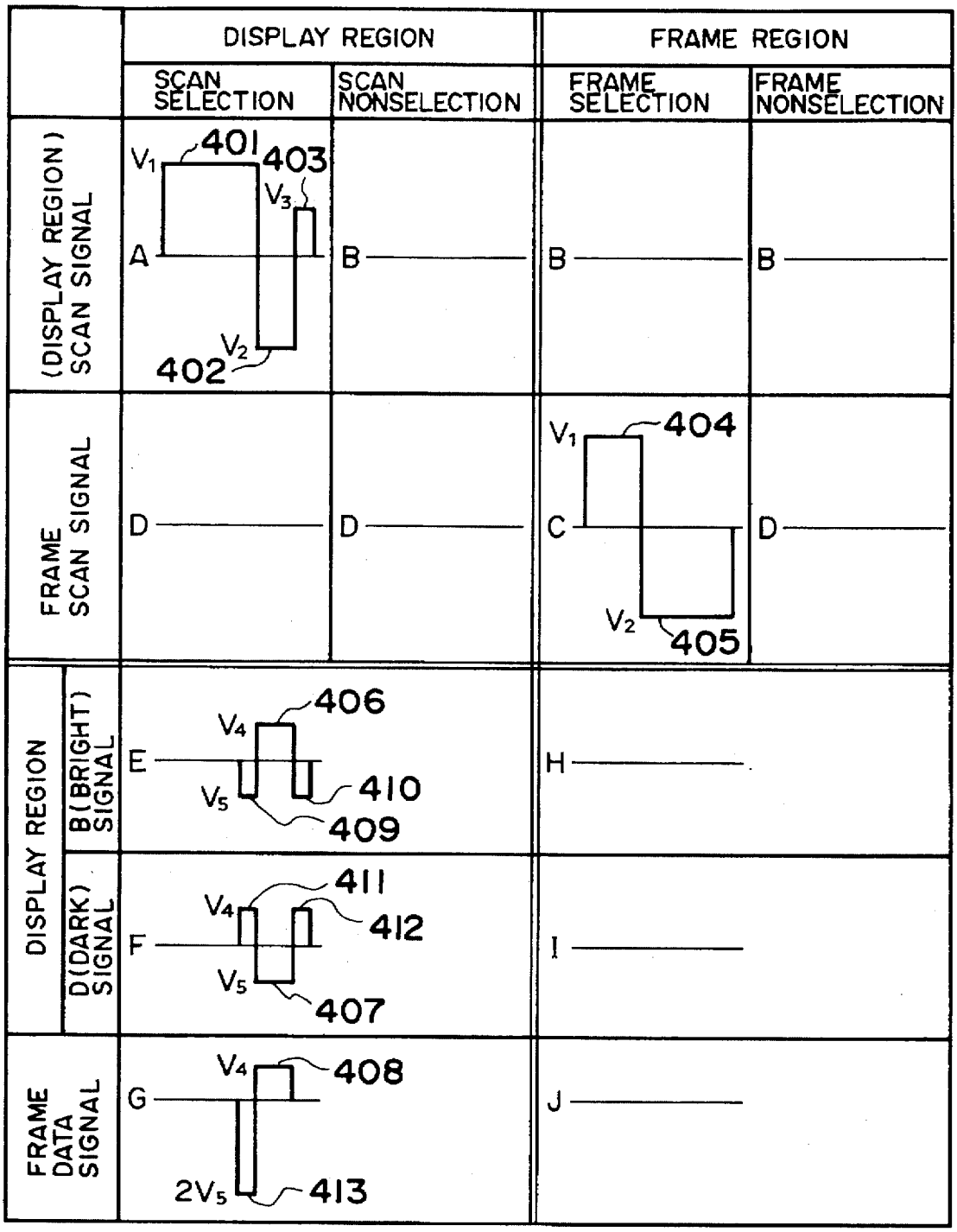
FIG. 4 shows an example set of drive signal waveforms used in the apparatus of FIG. 1.

FIG. 4 shows a set of drive signal waveforms used in this embodiment. Referring to FIG. 4, at A is shown a scanning selection signal waveform applied to scanning electrodes in the display region 102, including a reset pulse 401, a selection pulse 402 and an auxiliary pulse 403. The reset pulse 401 is used for resetting all the pixels on a selected scanning electrode 202 (FIG. 2A) into a dark state. At B is shown a scanning nonselection signal waveform for the display region having a voltage level of zero. At C is shown a scanning selection signal waveform applied to frame scanning electrodes, including an auxiliary pulse 404 and a reset pulse 405 for resetting all the pixels on the frame scanning electrodes to a bright state when the frame scanning electrodes 203 (FIG. 2A) are selected. At D is shown a scanning nonselection signal applied to the frame scanning electrodes 203 having a voltage level of zero. At E is shown a bright data signal at the time of scanning the display region. At F is shown a dark data signal at the time of scanning the display region. At G is shown a frame data signal at the time of scanning the display region. The data signals at E–G respectively comprise selection pulses 406–408 and auxiliary pulses 409–413 before and after the selection pulses, thereby making an average voltage zero within a unit period. Data signals at H, I and J are a bright data signal, a dark data signal and a frame data signal, respectively, at the time of scanning the frame region, each having a voltage level of zero.

The data signals at the time of scanning the frame region are made zero for the following reason.

(1) To obviate the necessity of generating display data for the upper and lower frame regions.

(2) To suppress the power consumption at the time of frame scanning.

(3) To obviate continuous scanning, thus increasing the durability.

The frame region is placed in the bright state because it provides a more moderate visual response to pulses below the threshold than the dark state, thus making less noticeable flicker, crosstalk and leakage of light, etc. due to alignment defect.

FIG. 5 shows voltage signals applied to pixels for displaying a bright state in the display region and in the frame region. Referring to FIG. 5, at K (A–E) is shown a voltage signal applied to a pixel in the display region 102 (FIG. 1), at L (A–G) is shown a voltage signal applied to a pixel in the frame regions **103*d* and 103*e* (FIG. 1), and at M (C) is shown a voltage signal applied to pixels in the frame region 103*a*, 103*b* and 103*c*** (FIG. 1).

Figure 6:
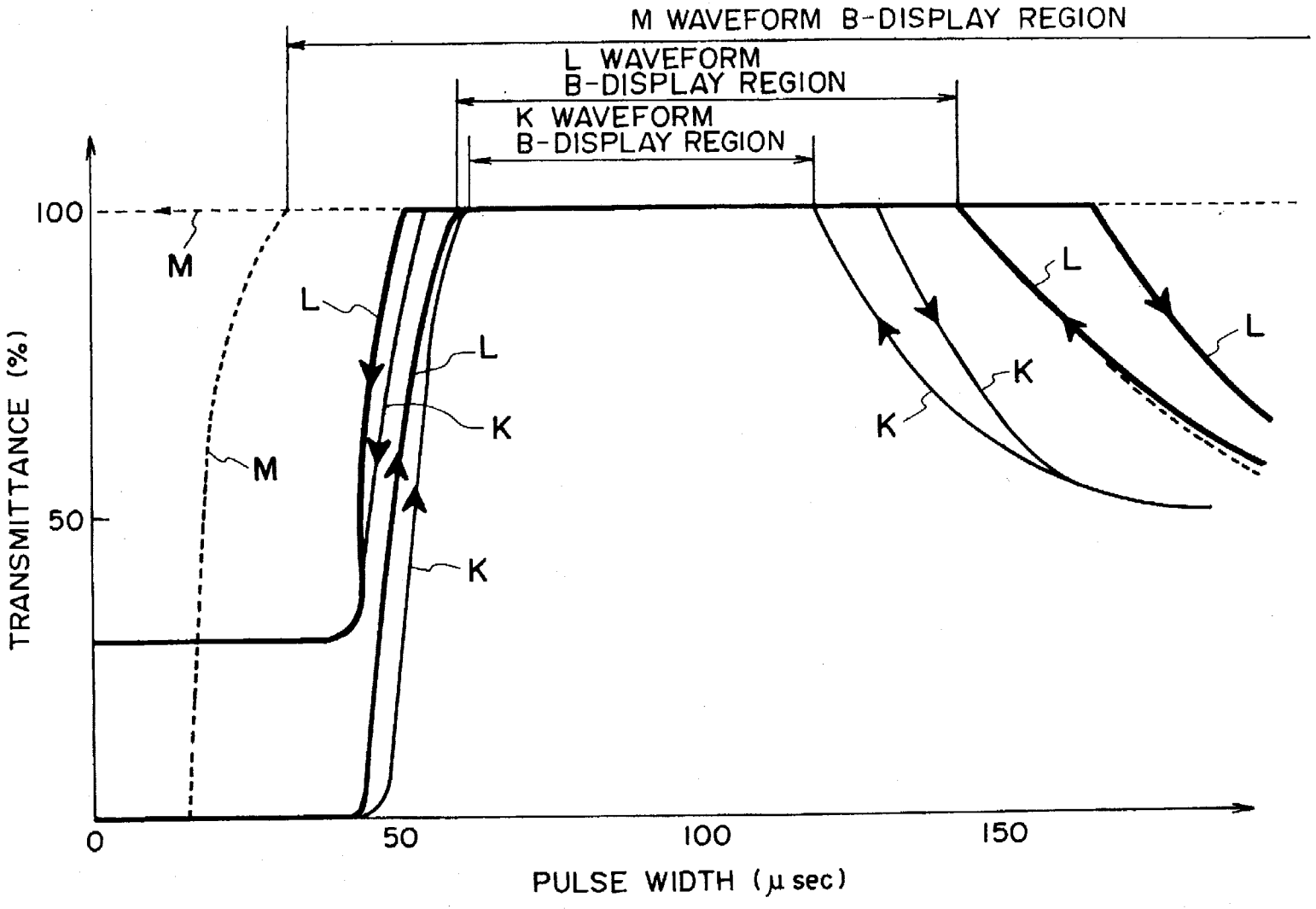
FIG. 6 is a graph showing a transmittance-pulse width characteristic obtained by applying the signals shown in FIG. 5 to the panels shown in FIGS. 1–3.

FIG. 6 shows transmittance—pulse width characteristics of the waveforms at K, L and M at 30° C. In FIG. 6, a thin solid line, a thick solid line and a dashed line represent the characteristics of the waveforms K, L and M, respectively.

The measurement for obtaining the characteristics shown in FIG. 6 was performed by initially gradually increasing the pulse width and later gradually narrowing the pulse width. The voltage levels were set to provide $V_1$=10 V, $V_2$=−10 V, $V_3$=5.5 V, $V_4$=5 V and $V_5$=−5 V. The transmittance is expressed by a relative value with respect to the bright state as 100%.

As shown in FIG. 6, the waveforms K, L and M all indicate a hysteresis. More specifically, the same pulse width provided different transmittances between the case of broadening the pulse width and the case of narrowing the pulse width. If the respective waveforms are compared with respect to the range capable of displaying the bright state, the waveforms L and M are stable in wider signal ranges than the waveform K. This means that the waveforms L and M provide a broader signal range wherein the bright state is retained in response to a fluctuation in threshold characteristic. Then, the wider drive margin in the frame region affords a stable display than before the display apparatus as a whole.

Figure 7:
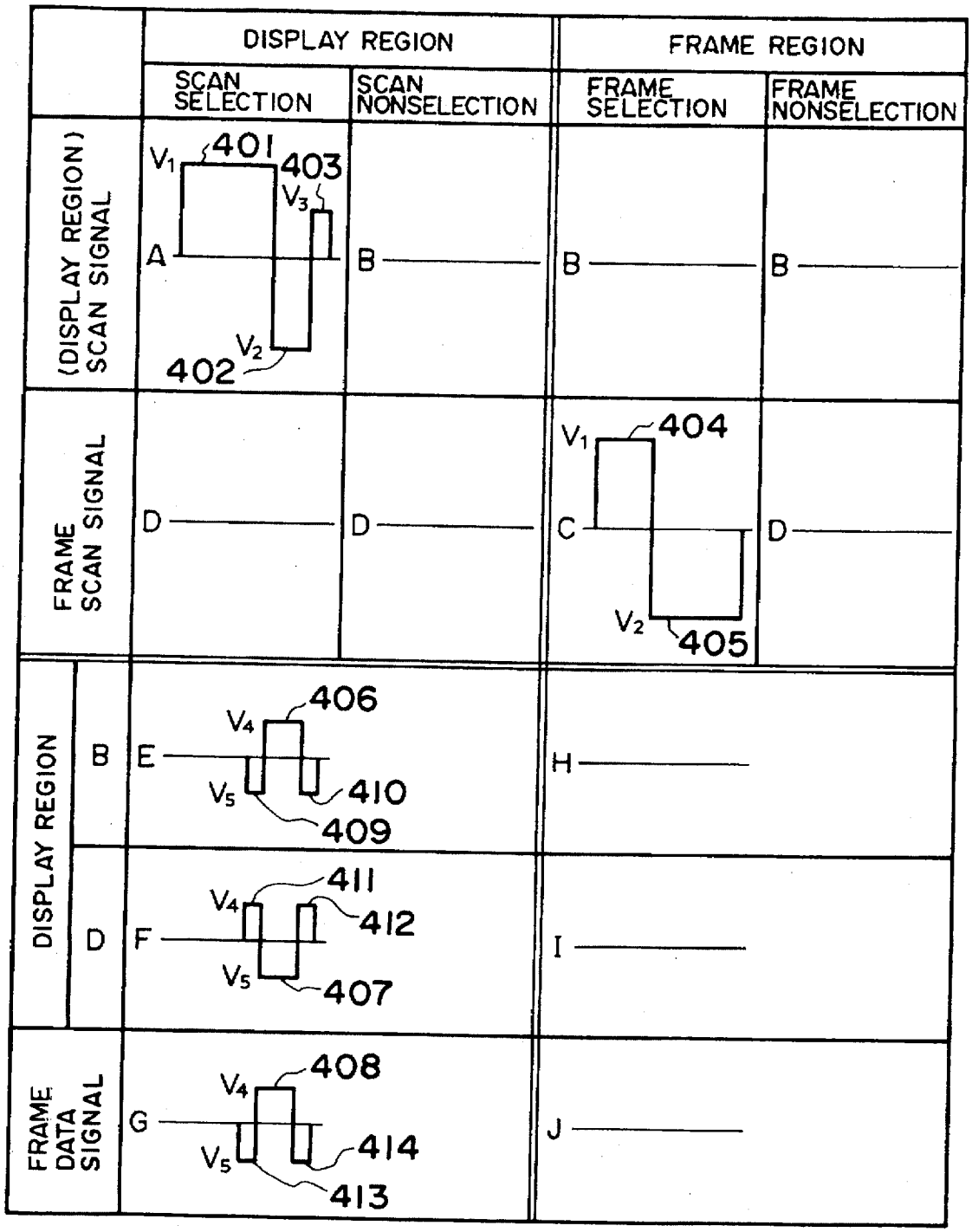
FIG. 7 shows a conventional set of drive signal waveforms.

FIG. 7 shows a conventional set of drive signal waveforms which are different from those of FIG. 4 only with respect to the waveform at G of a frame data signal at the time of scanning the display region. More specifically, the waveform G is the same as the waveform E in FIG. 7, whereas the waveform G in FIG. 4 lacks an auxiliary pulse 414 corresponding to the auxiliary pulse 410 in the waveform E after the selection pulse 408 and instead has a fore-side auxiliary pulse 413 having an increased amplitude of 2 $V_5$. When the set of drive signal waveform signals shown in FIG. 7 are used for driving the apparatus shown in FIG. 1, the drive margin for displaying the bright state in the frame region is not broadened because the bright data signal (waveform E) and the frame data signal (waveform G) are identical.

Figure 8:
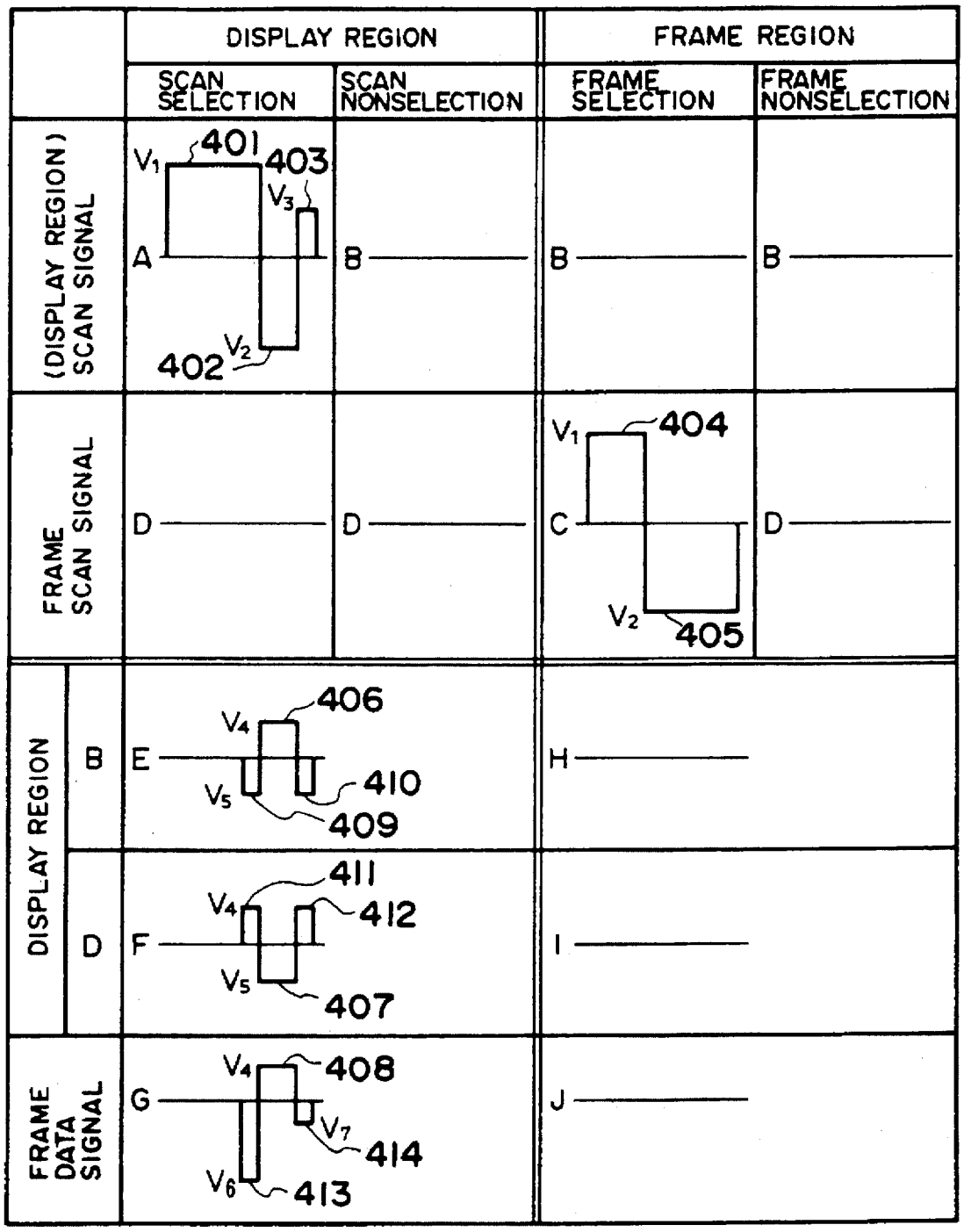
FIG. 8 shows a set of drive signal waveforms according to another embodiment of the present invention.

FIG. 8 shows another set of drive signal waveforms used in the present invention. When the panel 102 shown in FIG. 1 is driven by this set of drive signal waveforms, a margin substantially identical to that obtained by using the waveforms shown in FIG. 4 is obtained. Further, by fine adjustment of $V_6$ and $V_7$, the signal range of good "bright" display can be adjusted to some extent. However, in contrast to the frame data signal waveform shown in FIG. 4, which includes only three voltage levels, $V_4$, 2 $V_5$ and zero, the frame signal waveform shown in FIG. 8 include four voltage levels of $V_4$, $V_6$, $V_7$ and zero, so that a frame data signal application circuit (not shown) dealing with four voltage levels is required in addition to the data signal application circuit 110 (FIG. 1) for the display region dealing with three voltage levels, thus incurring a higher production cost.

FIG. 9 is a time chart for illustrating transfer of signals between the graphic controller 112 and the drive control circuit 111 in FIG. 1. Referring to FIGS. 1 and 9, "SYNC" represents a synchronizing signal including a "L" level indicating a command of data transfer from the drive control circuit 111 to the graphic controller 112. Data are transferred as four bit parallel data (PD0–PD3) for each transfer clock pulse. Herein, address data and display data are transferred by a common data bus. "AH/DH" denotes a signal for discriminating the type of transferred signals including a "H" level showing the transfer of the address data and a "L" level indicating the transfer of the display data.

In a test for the above embodiments, a pyrimidine-based mixture ferroelectric liquid crystal showing the following parameters and phase transition series was:

$Ps$=6.1 nC/cm$^2$ (30° C.)

Tilt angle=14.6 degrees (30° C.)

$\Delta\epsilon$=−0.2 (30° C.)

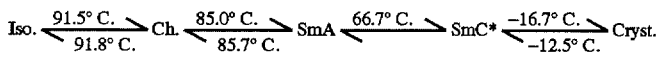

According to the above embodiment, a good display state can be retained in the frame region and thus over the entire panel by applying a waveform providing a broader margin to the liquid crystal in the frame region than the waveform applied to the liquid crystal in the display region.

[Second Embodiment]

Figure 10:
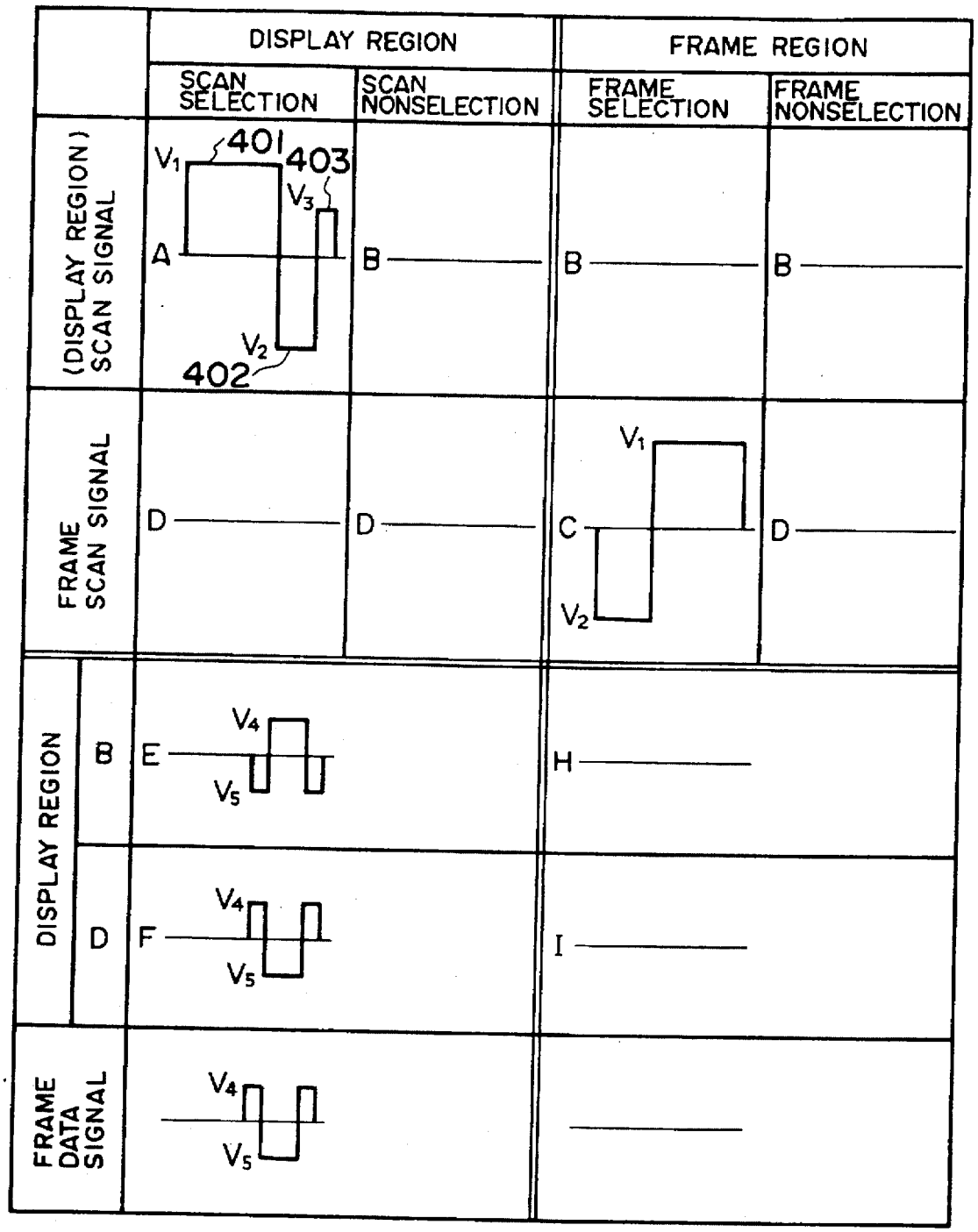
FIG. 10 shows a set of drive signal waveforms according to still another embodiment of the present invention.

FIG. 10 shows another set of drive signal waveforms applied to a liquid crystal display apparatus identical to the one shown in FIG. 1. The waveforms shown in FIG. 10 are different from those of FIGS. 4 and 7 in waveform C as a scanning selection signal waveform for the frame region and in waveform G as a frame data signal at the time of scanning the display region. More specifically, in contrast with the waveforms C in FIGS. 4 and 7 having a function of resetting all the pixels on the frame scanning electrodes 203 (FIG. 2A) into "bright" state at the time of frame scanning selection, the waveform C shown in FIG. 10 has a function of resetting the pixels into "dark" state by having reversed polarity phases. Further, in contrast with the waveforms G in FIGS. 4 and 7 having a function of driving the frame region to the "bright" state at the time of scanning the display region, the waveform G in FIG. 10 has a function of retaining the "dark" state resultant after application of the reset pulse 401 in waveform A by using phases of reversed polarities with respect to the waveform G in FIG. 7.

FIG. 11 shows voltage signals applied to the pixels. Referring to the figure, at P is shown a voltage signal applied to a pixel in the display region for displaying a "bright" state, at Q is shown a voltage signal applied to pixels in both the display region 102 and frame regions 103*d* and 103*e* (FIG. 1) for displaying the dark state, and at R is shown a voltage signal applied to the pixels in the frame regions 103*a*, 103*b* and 103*c* (FIG. 1) for displaying the dark state.

As described hereinbefore, when a voltage is continually applied for a long period, liquid crystal-lacking portions (voids) are liable to occur on a side of the liquid crystal panel (FIGS. 1 and 15) due to a liquid crystal movement. In a panel having frame regions, such liquid crystal voids are liable to occur in a frame region on a side and irregularly thick portions are liable to occur in a frame region on the opposite side.

According to this embodiment using a frame region held in the dark state, the display state in the frame region is retained in a good state owing to the following effects.

A first effect of this embodiment is that a void, even if caused, is not readily recognizable. More specifically, a liquid crystal void failing to show the birefringence effect appears "dark" in combination of a polarizer and an analyzer disposed in cross nicols. In this embodiment, the frame region is held in "dark" so that the voids giving a "dark" state are made less noticeable. However, liquid crystal molecules in a dark state are perturbed by application of an electric field, thus failing to provide a complete dark display. Accordingly, in order not to prevent a visual difference between the voids are the dark display portion, it is desirable to suppress the luminance to at most 2 cd/cm$^2$ or the transmittance to at most 0.1% at the dark display portion. This may be achieved by the following techniques (i)–(iv).

Figure 12:
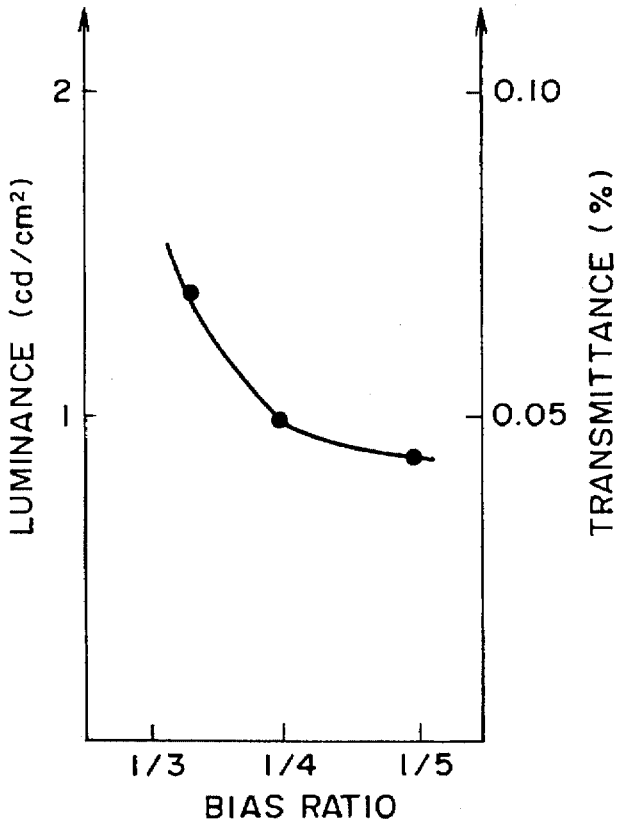
FIG. 12 is a graph showing luminance & transmittance-bias ratio characteristics of the panel shown in FIGS. 1–3.

(i) The amplitude of the data signals is reduced. More specifically, if the amplitude of the frame data signal is reduced so as to provide a smaller bias ratio (as defined by $V_4/[V_4-V_2]$) of e.g., 1/3.3, 1/3.9 or 1/5.5, the perturbation of liquid crystal at non-selected pixels is reduced, thus providing a darker dark display state. FIG. 12 shows a transmittance characteristic of a dark display part depending on the change in bias ratio.

Figure 13:
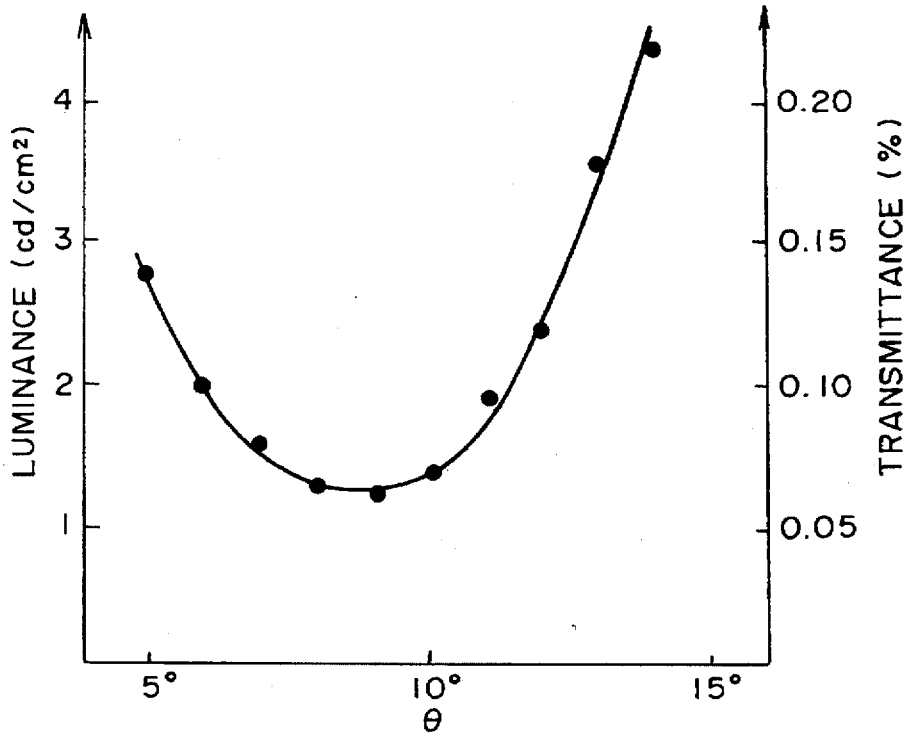
FIG. 13 is a graph showing luminance & transmittance-panel deviation angle θ characteristics of the panel shown in FIGS. 1–3.

(ii) The polarizer and analyzer positions are optimized. The transmittance can also be changed by varying the positions of the analyzer and polarizer relative to the liquid crystal molecular layer orientation. FIG. 13 shows a transmittance change observed by varying an angle θ (deviation angle) between the layer orientation direction and the polarization direction of the analyzer while keeping the relative positions of the polarizer and analyzer at right-angle cross nicols. In this embodiment, the darkest state was obtained at 41° C., a bias ratio 1/3.3 and θ=9 degrees.

(3) The luminance of the backlight is reduced.

(4) A liquid crystal cell having a steep threshold characteristic is used.

A second effect of this embodiment is that the dark display at the frame region is stable against the change in cell thickness. If the cell thickness is increased, a weaker electric field is applied to the liquid crystal, so that it becomes easier to retain a state given by the reset pulse.

Figure 14:
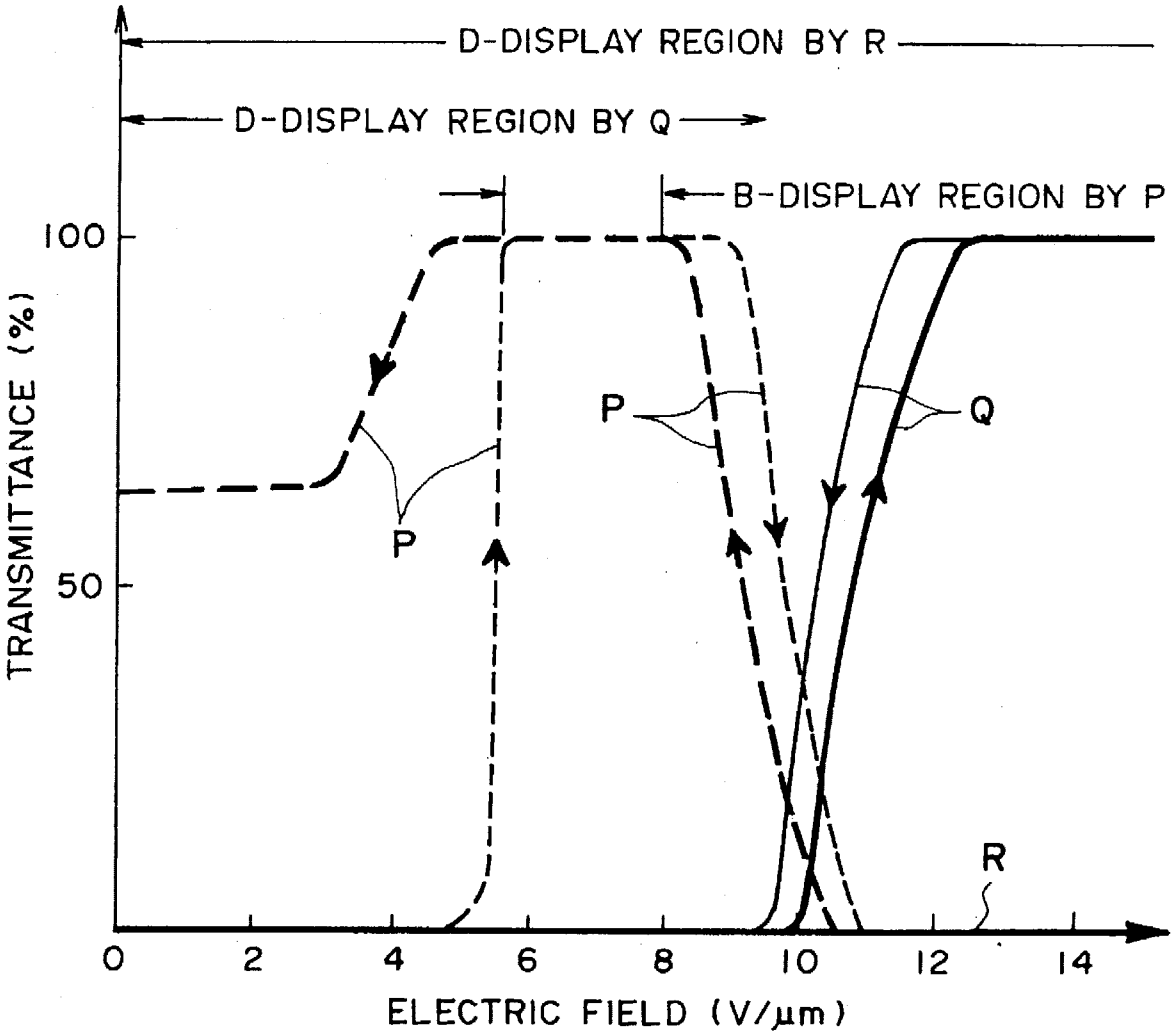
FIG. 14 is a graph showing a transmittance-pulse width characteristic obtained by applying the signals shown in FIG. 11 to the panels shown in FIGS. 1–3.

FIG. 14 shows transmittance-electric field characteristics obtained by driving the display region 2 in FIGS. 1–3 at 30° C. by applying voltage signal waveforms P, Q and R shown in FIG. 11.

The measurement for obtaining the characteristics shown in FIG. 14 was performed by initially gradually increasing the electric field $(V_4-V_2)/d$ (d: cell thickness) from the dark state and later gradually decreasing the electric field. In FIG. 14, a dashed line, a thin solid line and a thick solid line represent the characteristics obtained by the waveforms P, Q and R, respectively. In FIGS. 10 and 11, the voltages were set to satisfy ratios of $V_1:V_2:V_3:V_4:V_5$=23:−23:11:10:−10, and the panel 102 had a cell thickness of about 1 μm. The transmittance is expressed by a relative value with respect to a transmittance in the bright state of 100%.

As shown in FIG. 14, the respective cells provided different transmittances at an identical electric field depending on whether the electric field is in the course of increase or in the course of decrease, thus showing a hysteresis. If the characteristics of the respective waveforms are compared with respect to the range capable of stably displaying the bright state, in the case of an increasing cell thickness, i.e., a decreasing electric field E, the waveform P causes a change from "bright" to "dark", whereas the waveforms Q and R continually display "dark". Accordingly, if the frame region is displayed in black, it is possible to provide a broader range capable of retaining a good display state than in the case of "bright" display.

Further, as the waveform R provides a broader signal range of stable display than the waveform Q, a larger effect of providing a darker dark display state if the frame region is so disposed that the defects are allowed to occur in the frame scanning electrode side regions 103*a*, 103*b* and 103*c* (FIG. 1) than in the frame data electrode side regions 103*d* and 103*e*. Accordingly, it is desired to set the rubbing direction in an angular region of −45 degrees to 45 degrees or 135 degrees to 225 degrees with respect to the direction of scanning electrodes.

A third effect of this embodiment is that a cell thickness change (a difference in retardation) is not readily sensed as a defect by a viewer. More specifically, interference fringe or color irregularity caused by a difference in retardation is noticeable in a bright display but is less noticeable and not recognized as a defect in a dark display.

As described above, according to this embodiment, wherein the frame region is displayed in dark, the occurrence of voids and the difference in retardation are hidden. Further, a waveform showing a lower threshold for dark display (inclusive of a waveform including a pulse for resetting into a dark state) is used, a larger cell thickness portion can provide a dark display. As a result, good display quality is retained for a long period without making noticeable a display defect caused by movement of liquid crystal molecules.

IN summary, according to the first embodiment of the present invention, a waveform providing a broader threshold characteristic range (margin) allowing a stable display with respect to a particular display state suitable for a frame region display than a drive waveform for the display region is used for driving the frame region, the frame region can be placed in the particular display state while allowing a broader range of fluctuation in cell thickness or temperature or a larger degree of deterioration in alignment state, thus enhancing the performance as a display apparatus.

According to the second embodiment of the present invention, the frame region is displayed in dark, whereby the occurrence of voids and the difference in retardation are less noticeable. Further, a waveform showing a lower threshold for dark display (inclusive of a waveform including a pulse for resetting into a dark state) is used, a larger cell thickness portion can provide a dark display. As a result, good display quality is retained for a long period without making noticeable a display defect caused by movement of liquid crystal molecules.

Now, a third embodiment of the present invention will be described. The switching threshold of a liquid crystal generally changes locally within a frame region and has a certain distribution, e.g., depending the liquid crystal injection direction, so that the threshold characteristic range (margin) allowing a stable frame display is different, e.g., between a frame region on frame data electrodes disposed on one side of the display region and a frame region on frame data electrodes disposed on the other side of the display region (FIG. 2B). Accordingly, in this embodiment, the signal waveform applied to the frame data electrodes in made different between the frame data electrodes on one side and the frame data electrodes on the other side, so as to be appropriate for the respective margins in the related frame regions, thus effecting an effective frame display.

It is possible to apply signal waveforms different in only amplitudes to the one and the other sides of frame data electrodes, respectively.

It is preferred that the frame scanning electrodes are disposed to extend in a direction along which a relatively intense distribution of switching threshold between the first and second stable states is developed, or in direction forming an angle in the range of −45 degrees to +45 degrees with respect to the direction of liquid crystal injection.

The signal applied from the drive signal application means to the frame scanning electrodes is one including a waveform resetting the liquid crystal into either one of the first and second stable states regardless of the previous state thereof. It is preferred that the frame is placed in a bright display state based on either one stable state.

Figure 16:
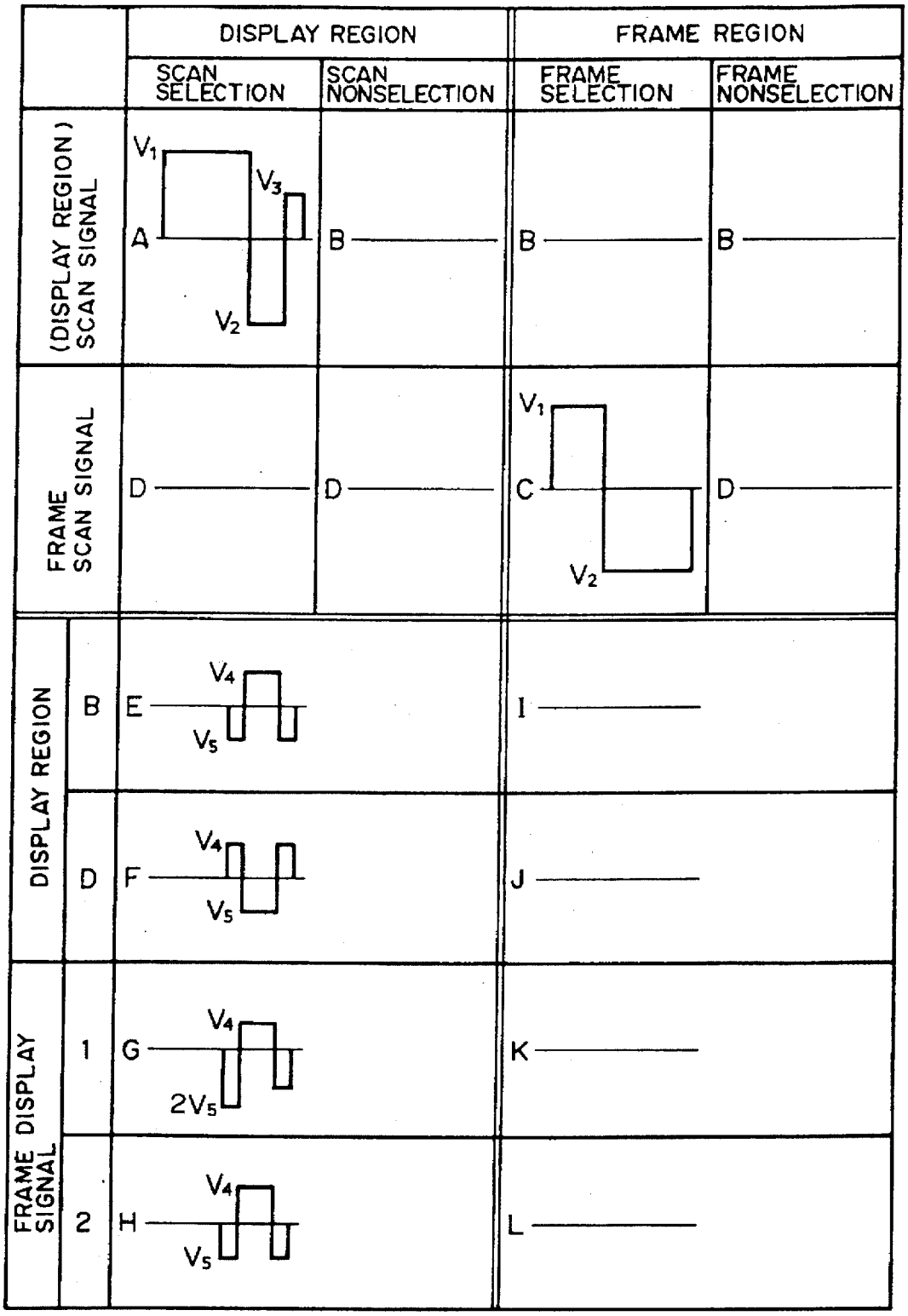
FIG. 16 shows a set of drive signal waveforms according to another embodiment of the present invention.

FIG. 16 shows a set of drive signal waveforms used in this embodiment and applied to the apparatus shown in FIG. 1. Referring to FIG. 16, at A is shown a scanning selection signal waveform applied to scanning electrodes in the display region 102, including a reset pulse $V_1$, a selection pulse $V_2$ and an auxiliary pulse $V_3$. The reset pulse $V_1$ is used for resetting all the pixels on a selected scanning electrode 202 (FIG. 2A) into a dark state. At B is shown a scanning nonselection signal waveform for the display region having a voltage level of zero. At C is shown a scanning selection signal waveform applied to frame scanning electrodes, including an auxiliary pulse $V_1$ and a reset pulse $V_2$ for resetting all the pixels on the frame scanning electrodes to a bright state when the frame scanning electrodes 203 (FIG. 2A) are selected.

At D is shown a scanning nonselection signal applied to the frame scanning electrodes having a voltage level of zero. At E is shown a bright data signal at the time of scanning the display region. At F is shown a dark data signal at the time of scanning the display region. At G is shown a frame data signal 1 applied to the frame data electrodes 206 in the frame region **103*d* (FIG. 2) at the time of scanning the display region. At H is shown a frame data signal 2 applied to the frame data electrodes 206 in the frame region 103*e* (FIG. 2) at the time of scanning the display region. The data signals at E–H respectively comprise selection pulses and auxiliary pulses before and after the selection pulses, thereby making an average voltage zero within a unit period. Data signals at I, J, K and L are a bright data signal, a dark data signal, a frame data signal 1 and a frame data signal 2**, respectively, at the time of scanning the frame region, each having a voltage level of zero.

The data signals at the time of scanning the frame region are made zero for the following reason.

(1) To omit the necessity of generating display data for the upper and lower frame regions.

(2) To suppress the power consumption at the time of frame scanning.

(3) To obviate continuous scanning, thus increasing the durability.

The frame region is placed in the bright state because it provides a more moderate visual response to pulses below the threshold than the dark state, thus making less noticeable flicker, crosstalk and leakage of light, etc. due to alignment defect.

FIG. 17 shows voltage signals applied to pixels for displaying a bright state in the display region and in the frame region. Referring to FIG. 17, at M is shown a voltage signal applied to pixels in the display region 102 and frame region **103*e* (FIG. 2), at O is shown a voltage signal applied to a pixel in the frame regions 103*a*, 103*b* and 103*c*, and at P is shown a voltage signal applied to pixels in the frame region 103*d* (FIG. 2**).

Figure 18:
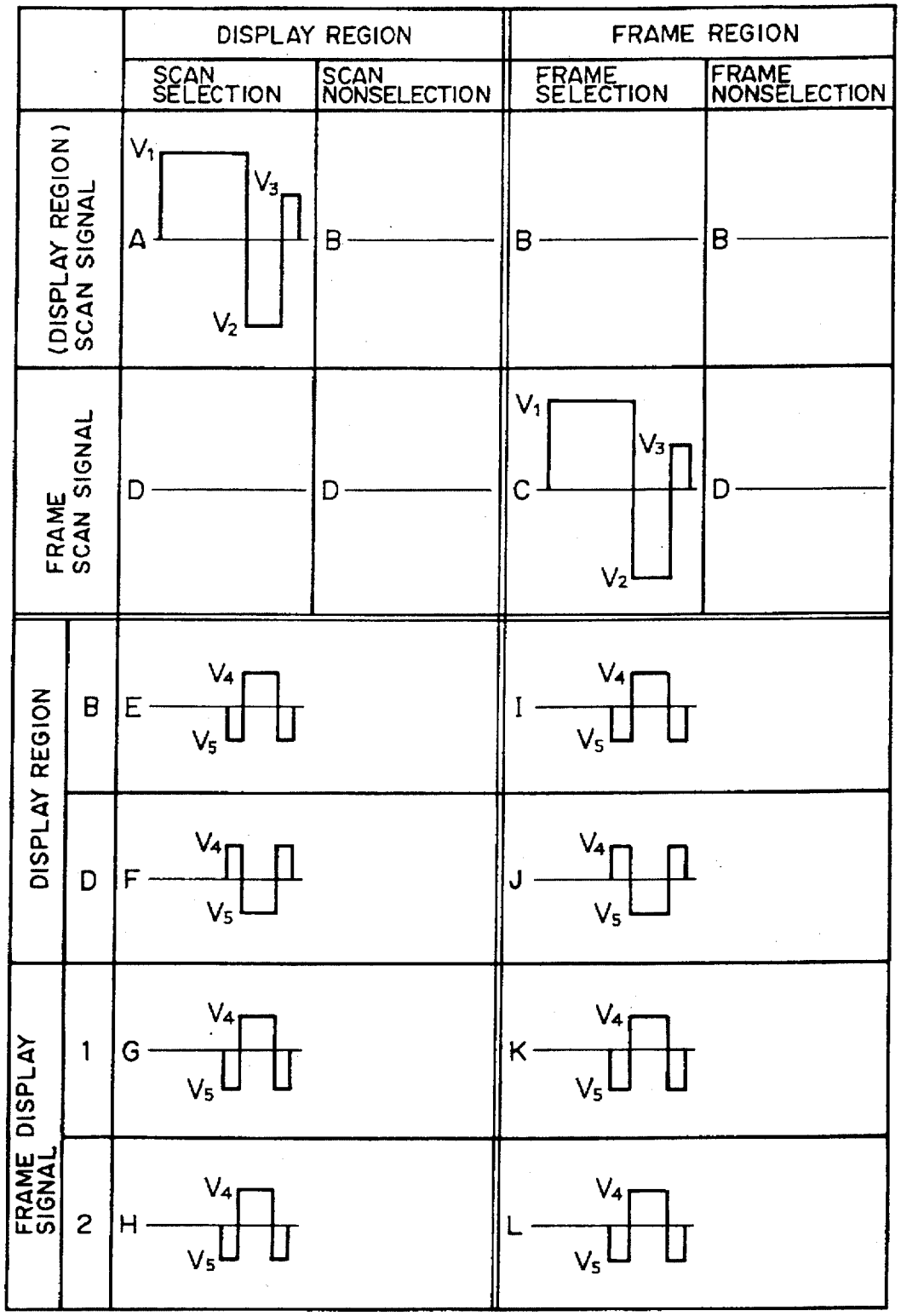
FIG. 18 shows a conventional set of drive signal waveforms.

FIG. 18 shows a conventional set of drive waveforms including identical signals applied to both the display region and the frame region. IN this case, a broader margin with respect to a bright display in the frame region cannot be obtained.

Figure 19:
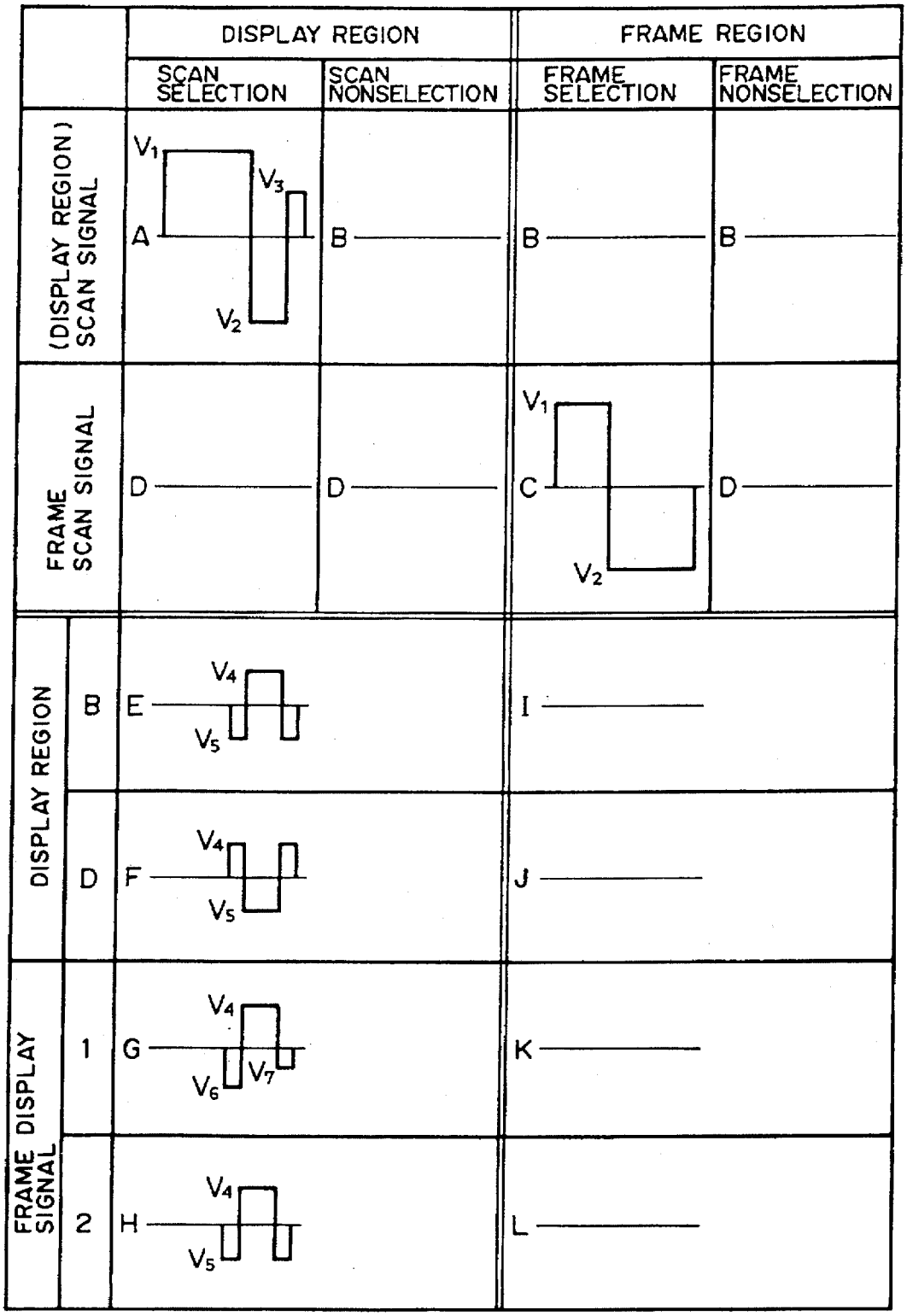
FIG. 19 shows a set of drive signal waveforms according to another embodiment of the present invention.
Figure 19:
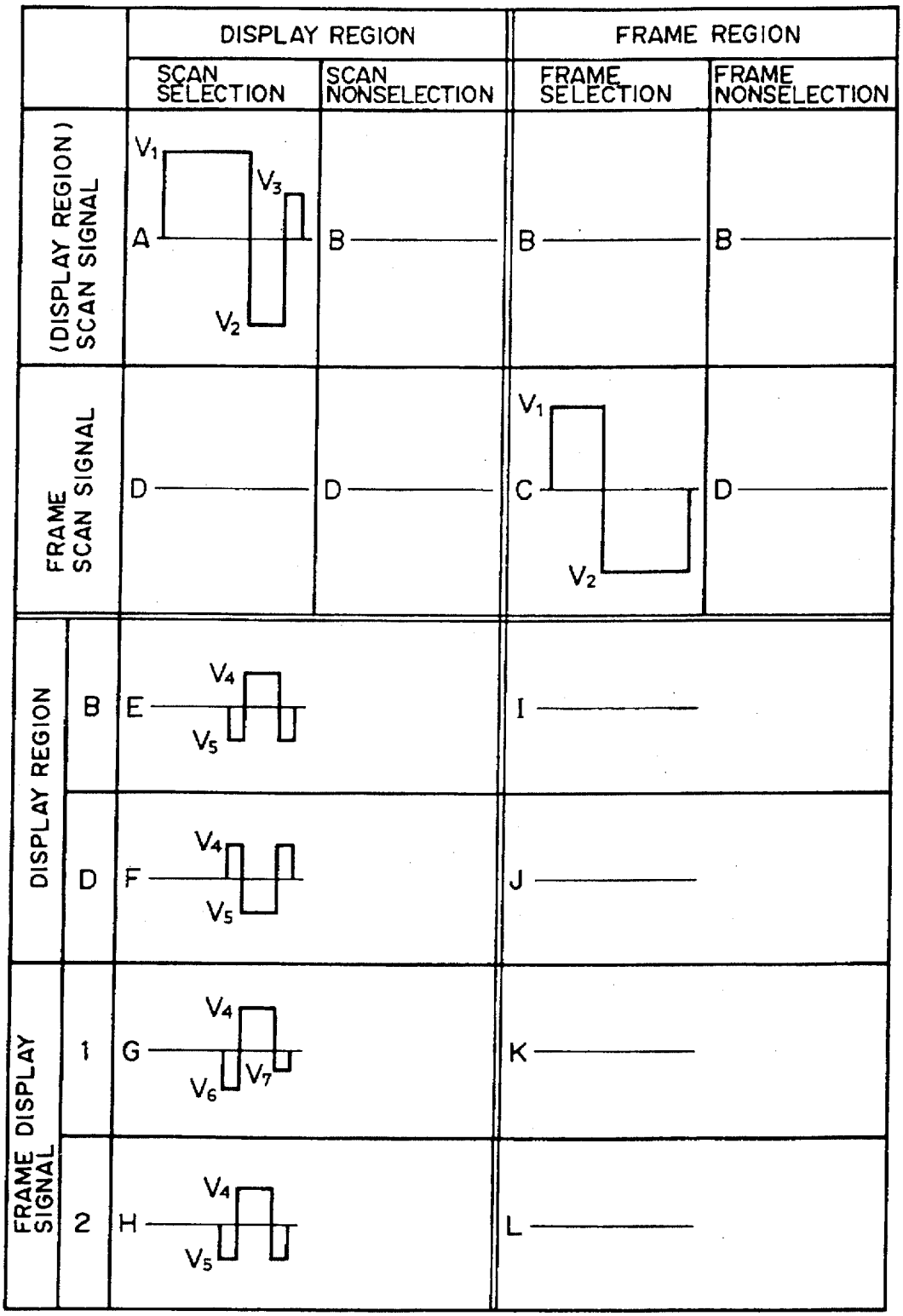

FIG. 19 shows another set of drive signal waveforms used in the present invention. When the panel 102 shown in FIG. 1 is driven by the set of drive signal waveforms, a margin substantially identical to that obtained by using the waveforms shown in FIG. 16 is obtained. Further, by fine adjustment of $V_6$ and $V_7$, the range of good "bright" display can be adjusted to some extent. However, different from the frame data signal waveform shown in FIG. 16 including only three voltage levels of $V_4$, 2 $V_5$ and zero, the data signal waveform shown in FIG. 19 include four voltage levels of $V_4$, $V_6$, $V_7$ and zero, so that a frame data signal application circuit (not shown) dealing with four voltage levels is required in addition to the data signal application circuit 110 (FIG. 1) for the display region dealing with three voltage levels, thus incurring a higher production cost.

Figure 20:
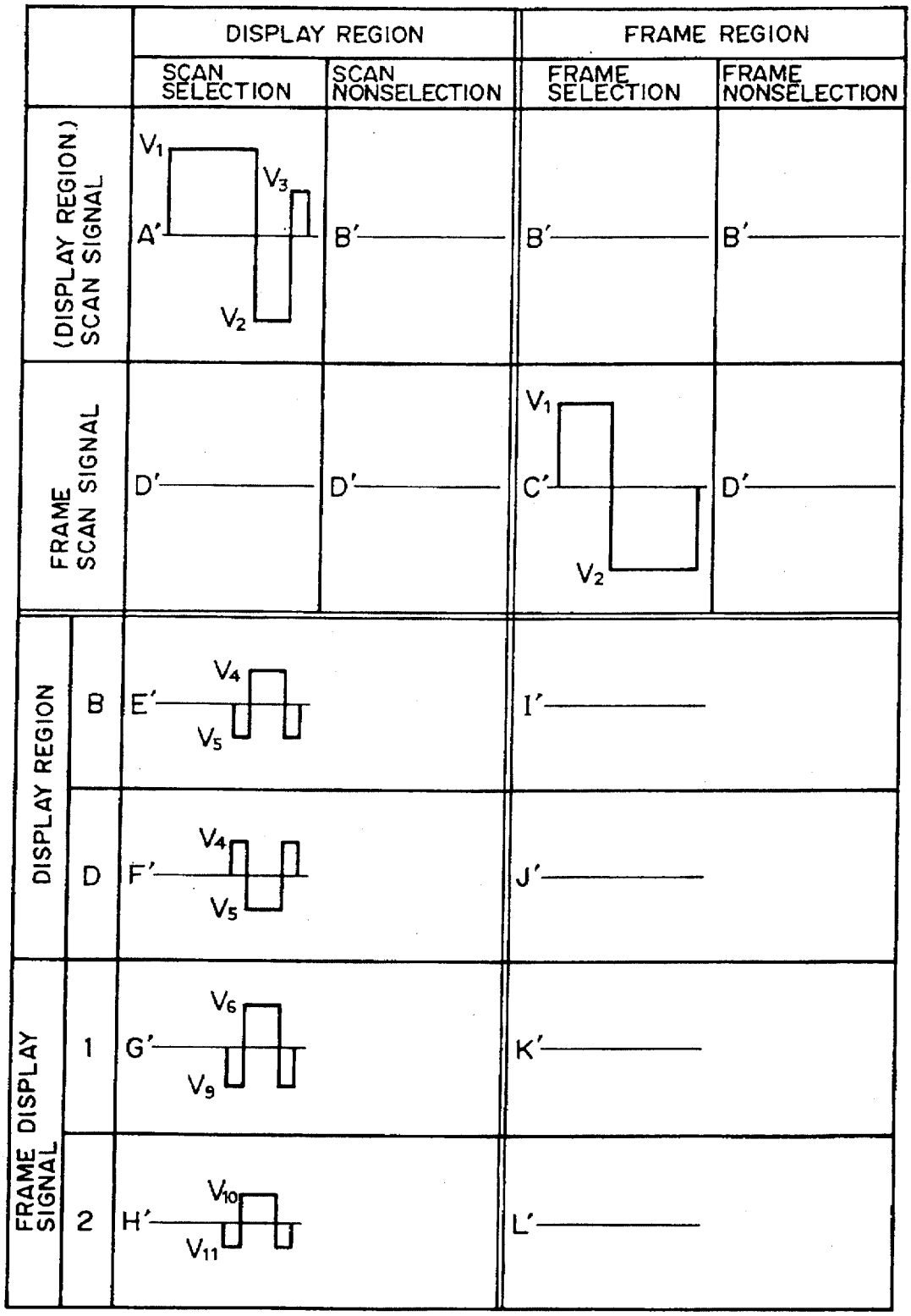
FIG. 20 shows a set of drive signal waveforms according to still another embodiment of the present invention.

FIG. 20 shows still another set of drive signal waveforms. The waveforms at A'–L' correspond to those at A–L, respectively, in FIG. 16, but the voltage levels are changed so as to satisfy relationships of $V_8>V_4>V_{10}$, and $|V_9|>|V_5>|V_{11}|$.

FIG. 21 shows voltage signals applied to pixels based on the signals shown in FIG. 20 for displaying a bright state in the display region and in the frame region. Referring to FIG. 21, at M' shown a voltage signal applied to a pixel in the display region 102, at O' is shown a voltage signal applied to pixels in the frame regions 103*a*, 103*b* and 103*c* (FIG. 2), at P' is shown a voltage signal applied to a pixel in the frame region 103*d*, and at Q' is shown a voltage signal applied to a pixel in the frame region 102*e*.

Figure 22:
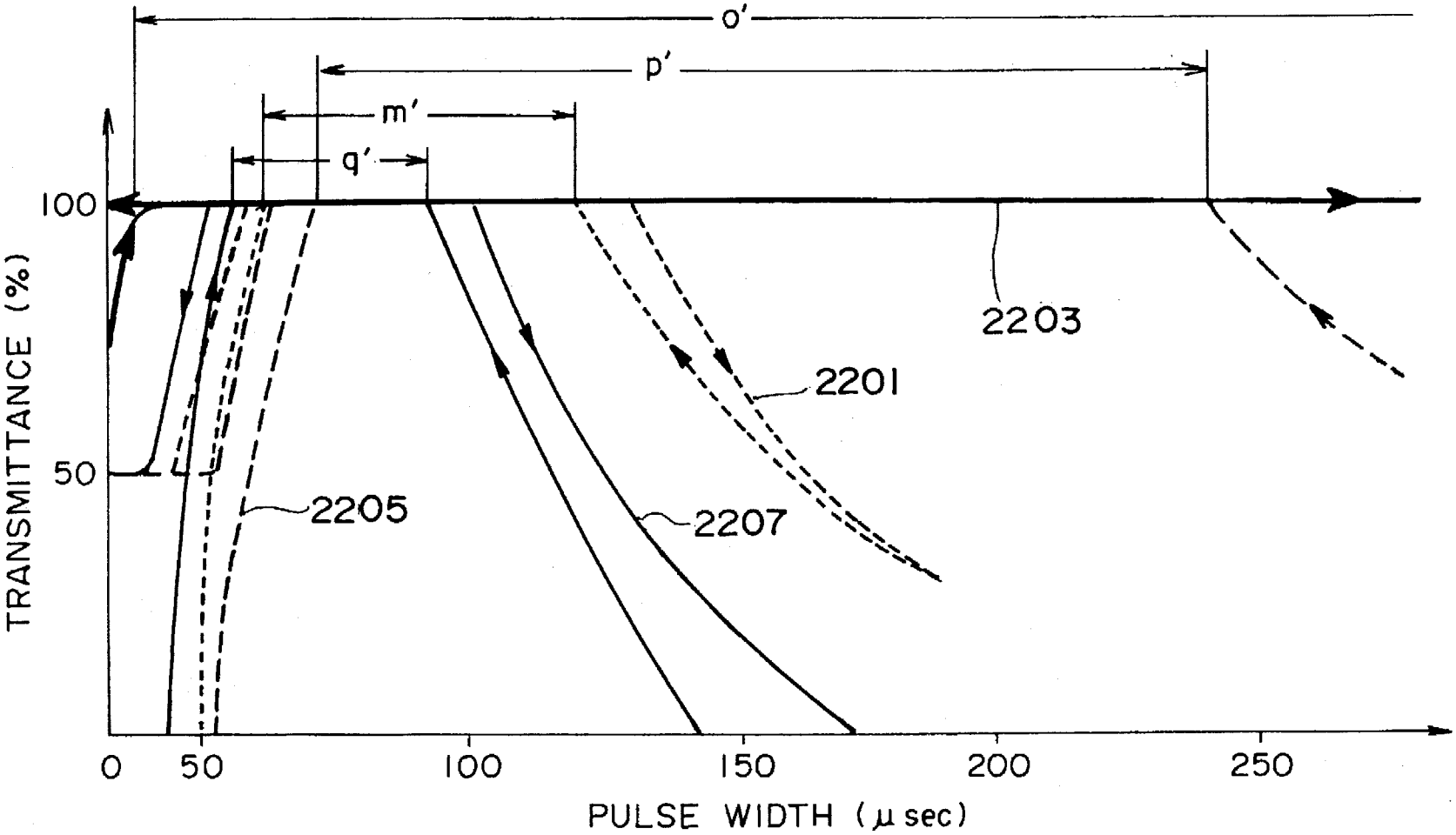
FIG. 22 is a graph showing transmittance-pulse width characteristic obtained by applying the pixel signals shown in FIG. 21.

FIG. 22 shows transmittance-pulse width characteristics of the waveforms at M', O', P' and Q' at 30° C. In FIG. 22, a dot line 2201 a thick solid line 2203, a dashed line 2205 and a solid line 2207 represent the characteristics of the waveforms M', O', P' and Q', respectively, which give bright display ranges of m', o', p' and q', respectively, as shown.

The measurement for obtaining the characteristics shown in FIG. 22 was performed by initially gradually increasing the pulse width (ΔT) and later gradually narrowing the pulse width. The voltage levels were set to provide $V_1$=10 V, $V_2$=−10 V, $V_3$=5.5 V, $V_4$=5 V, $V_5$=−5 V, $V_8$=6.5 V, $V_9$=−6.5 V, $V_{10}$=3.5 V and $V_{11}$=−3.5 V. The transmittance is expressed by a relative value with respect to the bright state as 100%.

As shown in FIG. 22, the waveforms M', O', P' and Q' all indicate a hysteresis providing different transmittances between the case of broadening the pulse width and the case of narrowing the pulse width. If the respective waveforms are compared with respect to the range capable of displaying the bright state, the waveform O' is stable in wider signal range than the waveform M'. Accordingly, the frame region 102*b* accompanied with an intense threshold distribution is provided with the waveform O' to keep a bright state, so as to cope with a intense threshold change.

Further, compared with the waveform M', the waveform P' provides a broader stable signal range in a longer pulse width direction. Accordingly, the frame region 103*d* having a higher threshold (requiring a longer pulse width) is provided with the waveform P' to display a bright state.

Further, compared with the waveform M', the waveform Q' provides a stable range in a shorter pulse width direction. Accordingly, the frame region 103*e* having a low threshold (i.e., requiring a short pulse width) is allotted with the waveform Q' to show a bright state, thereby ensuring a good display state even in case of a lower threshold.

In this way, the respective frame regions are allotted with appropriate waveforms depending on their threshold characteristics, whereby a good display state is ensured over the entire display panel.

As described above, according to the present invention, the frame regions on the respective sides are allotted with suitable signal waveform to stabilize the display of the frame region, thereby ensuring a good display state over the entire panel.

What is claimed is:

1. A liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode outside the display data electrodes, and a liquid crystal having a memory characteristic disposed between the first and second electrode plates so as to form a display region defined by an overlapping of the display scanning electrodes and the display data electrodes and a frame region outside the display region defined by the frame scanning electrode and the frame data electrode, wherein the liquid crystal is allowed to assume either one of two stable states at each pixel formed at each intersection of any data electrode and any scanning electrode, and a drive means for applying a display signal waveform corresponding to given display data to the liquid crystal in the display region, and applying a frame signal waveform providing one of the two stable states of liquid crystal to the liquid crystal in the frame region, respectively via the electrode plates, wherein the two stable states of the liquid crystal provide a bright state and a dark state, respectively, and the frame signal waveform applied to the liquid crystal in the frame region keeps the liquid crystal in the frame region in the bright state and has a wider signal range for ensuring said bright state than the display signal waveform, and wherein:

(a) the display signal waveform includes:

a scanning signal applied to each selected display scanning electrode including a reset pulse for resetting the liquid crystal into the dark state, a scanning selection pulse for setting a desired display state of the liquid crystal and a scanning auxiliary pulse, and a data signal applied to each display data electrode including a data selection pulse synchronized with the scanning selection pulse for forming a desired stable state at a pixel at an intersection of the selected display scanning electrode and said each display data electrode, and a display auxiliary pulse placed before and after the data selection pulse for providing an average voltage of zero together with the data selection pulse; and (b) the frame signal waveform applied to the frame data electrode includes a frame selection pulse synchronized with the scanning selection pulse for setting the bright state at a frame pixel formed at an intersection of the selected display scanning electrode and the frame data electrode and a frame auxiliary pulse placed before the frame selection pulse for providing an average voltage of zero together with the frame selection pulse, wherein the data auxiliary pulses placed before and after the data selection pulse have mutually identical pulse width and pulse amplitude, and the frame auxiliary pulse placed before the frame selection pulse has a substantially identical pulse width with the data auxiliary pulse;

said average voltage and pulse amplitude being respectively defined with respect to the voltage level of a non-selected display scanning electrode.

2. A liquid crystal apparatus according to claim 1, wherein said frame auxiliary pulse has a pulse amplitude which is twice that of the data auxiliary pulse.

3. A liquid crystal apparatus according to claim 1, wherein said frame scanning electrode is supplied with such a signal waveform at a time of selection thereof as to comprise a frame scanning auxiliary pulse and a reset pulse for resetting all pixels on the frame scanning electrode into the bright state.

4. A liquid crystal apparatus according to claim 1, wherein said liquid crystal having a memory characteristic is a ferroelectric liquid crystal.

5. A liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode disposed on both outsides of the display data electrodes, and a liquid crystal having a memory characteristic disposed between the first and second electrode plates so as to form a display region defined by an overlapping of the display scanning electrodes and the display data electrodes and a frame region outside the display region defined by the frame scanning electrode and the frame data electrodes, wherein the liquid crystal is allowed to assume either one of two stable states at each pixel formed at each intersection of any data electrode and any scanning electrode, and a drive means for applying drive signals to the respective electrodes to effect a desired display in the display region and a constant display in the frame region, wherein said drive means applies different drive signals to the frame data electrodes on both outsides of the display electrodes, and wherein said frame scanning electrode is disposed to extend in a direction with an angular range of −45 degrees to +45 degrees with respect to a direction in which the liquid crystal has been injected into the matrix device.

6. A liquid crystal apparatus according to claim 5, wherein the drive waveforms applied to said frame data electrode on both outsides are different in only voltages.

7. A liquid crystal apparatus according to claim 5, wherein said frame scanning electrode is disposed to extend in a direction along which a relatively large distribution of switching threshold between the two stable states is present.

8. A liquid crystal apparatus according to claim 5, wherein the drive means applies a signal waveform to a frame scanning electrode functioning to reset a pixel on the frame scanning electrode into one of the two stable states regardless of a previous display state of the pixel.

9. A liquid crystal apparatus according to claim 5, wherein said frame region is placed in the constant display state of bright based on one of the two stable states.

10. A liquid crystal apparatus according to claim 5, wherein said liquid crystal is a ferroelectric liquid crystal.

11. A liquid crystal apparatus, comprising:

a matrix display device including a first electrode plate having thereon a group of display scanning electrodes and a frame scanning electrode outside the display scanning electrodes, a second electrode plate having thereon a group of display data electrodes and a frame data electrode outside the display data electrodes, and a liquid crystal having a memory characteristic disposed between the first and second electrode plates so as to form a display region defined by an overlapping of the display scanning electrodes and the display data electrodes and a frame region outside the display region defined by the frame scanning electrode and the frame data electrode, wherein the liquid crystal is allowed to assume either one of two stable states at each pixel formed at each intersection of any data electrode and any scanning electrode, and a drive means for applying a display signal waveform corresponding to given display data to the liquid crystal in the display region, and applying a frame signal waveform providing one of the two stable states of liquid crystal to the liquid crystal in the frame region, respectively via the electrode plates, wherein the two stable states of the liquid crystal provide a bright state and a dark state, respectively, and the frame signal waveform applied to the liquid crystal in the frame region keeps the liquid crystal in the frame region in the bright state and has a wider signal range for ensuring said bright state than the display signal waveform, and wherein:

(a) the display signal waveform includes:

a scanning signal applied to each selected display scanning electrode including a reset pulse for resetting the liquid crystal into the dark state, a scanning selection pulse for setting a desired display state of the liquid crystal and a scanning auxiliary pulse, and a data signal applied to each display data electrode including a data selection pulse synchronized with the scanning selection pulse for forming a desired stable state at a pixel at an intersection of the selected display scanning electrode and Said each display data electrode, and a display auxiliary pulse placed before and after the data selection pulse for providing an average voltage of zero together with the data selection pulse; and (b) the frame signal waveform applied to the frame data electrode includes a frame selection pulse synchronized with the scanning selection pulse for setting the bright state at a frame pixel formed at an intersection of the selected display scanning electrode and the frame data electrode and a frame auxiliary pulse placed before and after the frame selection pulse for providing an average voltage of zero together with the frame selection pulse, wherein the data auxiliary pulses placed before and after the data selection pulse have mutually identical pulse width and pulse amplitude, and the frame auxiliary pulse placed after the frame selection pulse has a substantially identical pulse width and a smaller pulse amplitude than the frame auxiliary pulse placed before the frame selection pulse which in turn has a substantially identical pulse width with the data auxiliary pulse;

said average voltage and pulse amplitude being respectively defined with respect to the voltage level of a non-selected display scanning electrode.

12. A liquid crystal apparatus according to claim 11, wherein said frame scanning electrode is supplied with a signal waveform at a time of selection thereof which comprises a frame scanning auxiliary pulse and a reset pulse for resetting all pixels on the frame scanning electrode into the bright state.

* * * * *

UNITED STATES PATENT AND TRADEMARK OFFICE

CERTIFICATE OF CORRECTION

PATENT NO. : 5,673,062

DATED : September 30, 1997

INVENTOR(S): KAZUNORI KATAKURA ET AL.

It is certified that error appears in the above-identified patent and that said Letters Patent is hereby corrected as shown below:

ON TITLE PAGE AT [57] ABSTRACT

Line 8, "plats" should read --plates--.

SHEET 2

Fig. 2A, "(46 LINS) should read --(46 LINES)--

INSERT FIGURE 5, as per attached sheet.

SHEET 8

Figures 9A, 9B, 9C, 9D:
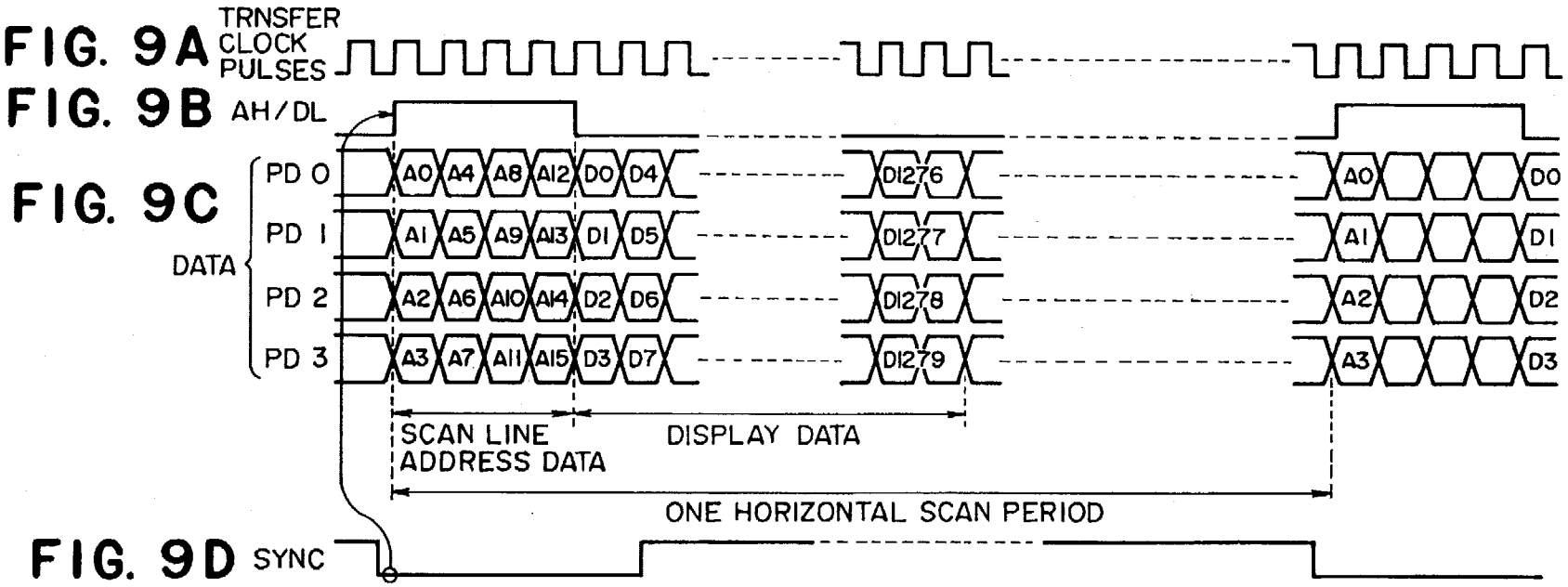
FIG. 9 is a communication time chart applied to the apparatus shown in FIG. 1.

Fig. 9A "TRNSFER" should read --TRANSFER--.

SHEET 18

Fig. 19, should be deleted (duplicated).

COLUMN 1

Line 3, "continuation," should read --continuation--;
Line 67, "necessary" should read --necessarily--.

COLUMN 2

Line 60, "exist" should read --exists--.

FIG. 5A K (A-E)
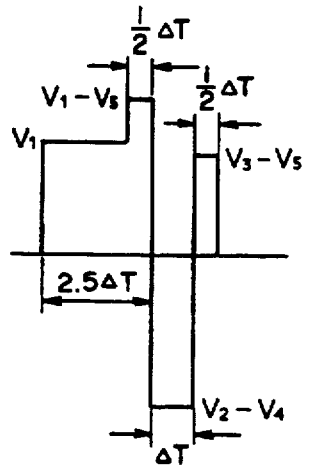
FIG. 5B L (A-G)
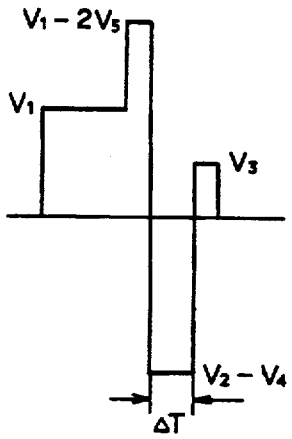
FIG. 5C M (C)
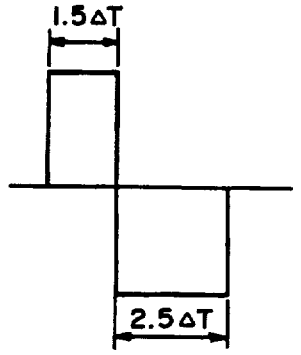

UNITED STATES PATENT AND TRADEMARK OFFICE

CERTIFICATE OF CORRECTION

PATENT NO. : 5,673,062

DATED : September 30, 1997

INVENTOR(S): KAZUNORI KATAKURA ET AL.

It is certified that error appears in the above-identified patent and that said Letters Patent is hereby corrected as shown below:

COLUMN 3

Line 46, "plats" should read --plates--.

COLUMN 4

Line 16, "plats" should read --plates--;
Line 37, "signal are" should read --signals and--;
Line 51, "plats" should read --plates--.

COLUMN 5

Figure 11A:
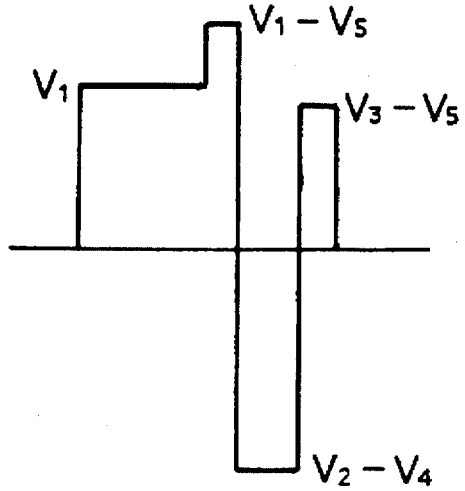
FIG. 11 shows pixel signals based on drive signal waveforms shown in FIG. 10.
Figure 11B:
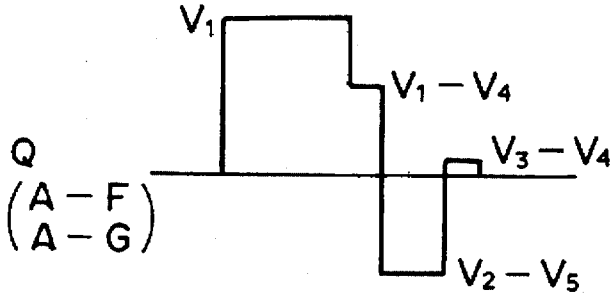
Figure 11C:
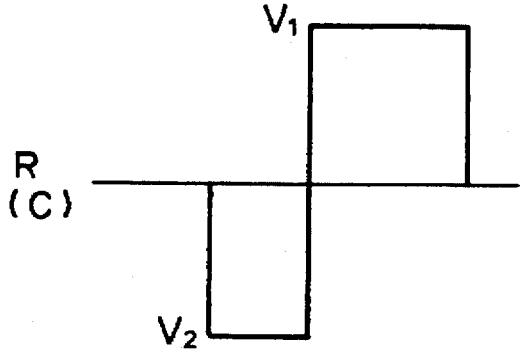

Line 18, "FIG. 5 shows" should read --FIGS. 5A-5C show--;
Line 22, "FIG. 5" should read --FIGS. 5A-5C--;
Line 27, "FIG. 9 is" should read --FIGS. 9A-9D constitute--;
Line 32, "FIG. 11 shows" should read --FIGS. 11A-11C show--;
Line 47, "FIG. 17 shows" should read --FIGS. 17A-17C show--;
Line 56, "FIG. 21 shows" should read --FIGS. 21A-21D show--;
Line 60, "FIG. 21" should read --FIGS. 21A-21D--.

COLUMN 6

Line 23, "(FIG. 2A," should read --(FIG. 2A)--.

COLUMN 7

Line 42, "reason." should read --reasons.--;
Line 54, "FIG. 5 shows" should read --FIGS. 5A-5C show--;
Line 56, "FIG. 5," should read --FIGS. 5A-5C,--.

UNITED STATES PATENT AND TRADEMARK OFFICE

CERTIFICATE OF CORRECTION

PATENT NO. : 5,673,062

DATED : September 30, 1997

INVENTOR(S): KAZUNORI KATAKURA ET AL.

It is certified that error appears in the above-identified patent and that said Letters Patent is hereby corrected as shown below:

COLUMN 8

Line 42, "2 $V_5$" should read --2$V_5$--;
Line 49, "FIG. 9 is" should read --FIGS. 9A-9D constitute--
Line 51, "FIGS. 1 and 9," should read --FIGS. 1 and 9A-9D--

COLUMN 9

Line 31, "FIG. 11 shows" should read --FIGS. 11A-11C show--

COLUMN 10

Line 20, "③" should read --(iii)--;
Line 21, "④" should read --(iv)--.

COLUMN 11

Line 45, "in" should read --is--;
Line 56, "in" should read --in a--.

COLUMN 12

Line 43, "FIG. 17 shows" should read --FIGS. 17A-17C show--
Line 45, "FIG. 17," should read --FIGS. 17A-17C,--.

UNITED STATES PATENT AND TRADEMARK OFFICE

CERTIFICATE OF CORRECTION

PATENT NO. : 5,673,062

DATED : September 30, 1997

INVENTOR(S): KAZUNORI KATAKURA ET AL.

It is certified that error appears in the above-identified patent and that said Letters Patent is hereby corrected as shown below:

COLUMN 13

Line 9, "FIG. 21 shows" should read --FIGS. 21A-21D show--;
Line 11, "FIG." should read --FIGS.--;
Line 12, "21," should read --21A-21D,-- and "shown" should read --is shown--;
Line 41, "a" should read --an--.

COLUMN 16

Line 29, "Said" should read --said--.

Signed and Sealed this

Nineteenth Day of May, 1998

*Attest:*

Bruce Lehman

BRUCE LEHMAN

*Attesting Officer*

*Commissioner of Patents and Trademarks*